US011112727B2

(12) United States Patent
Moon et al.

(10) Patent No.: US 11,112,727 B2
(45) Date of Patent: Sep. 7, 2021

(54) INTERFACE STRUCTURE FOR TONER REFILL CARTRIDGE AND TONER REFILL PORTION

(71) Applicant: HEWLETT-PACKARD DEVELOPMENT COMPANY, L.P., Spring, TX (US)

(72) Inventors: Yong Il Moon, Suwon (KR); Woong Yong Choi, Suwon (KR)

(73) Assignee: HEWLETT-PACKARD DEVELOPMENT COMPANY, L.P., Spring, TX (US)

( * ) Notice: Subject to any disclaimer, the term of this patent is extended or adjusted under 35 U.S.C. 154(b) by 0 days.

(21) Appl. No.: 17/048,895

(22) PCT Filed: Dec. 21, 2018

(86) PCT No.: PCT/KR2018/016416
§ 371 (c)(1),
(2) Date: Oct. 19, 2020

(87) PCT Pub. No.: WO2020/045764
PCT Pub. Date: Mar. 5, 2020

(65) Prior Publication Data

US 2021/0240101 A1 Aug. 5, 2021

(30) Foreign Application Priority Data

Aug. 30, 2018 (KR) ..... 10-2018-0102557

(51) Int. Cl.
*G03G 15/08* (2006.01)
*G03G 21/16* (2006.01)

(52) U.S. Cl.
CPC ..... *G03G 15/0886* (2013.01); *G03G 15/087* (2013.01); *G03G 21/1676* (2013.01);
(Continued)

(58) Field of Classification Search
CPC ..... G03G 15/0867; G03G 15/087; G03G 15/0877; G03G 15/0886; G03G 21/1642;
(Continued)

(56) References Cited

U.S. PATENT DOCUMENTS 5,848,338 A * 12/1998 Okada ..... G03G 15/0886 399/262
5,995,788 A 11/1999 Baek
(Continued)

FOREIGN PATENT DOCUMENTS

EP 1293843 3/2003
JP 05303276 11/1993

*Primary Examiner* — Benjamin R Schmitt
(74) *Attorney, Agent, or Firm* — Staas & Halsey, LLP

(57) ABSTRACT

A toner refilling interface structure including a toner cartridge, an installation portion, a first toner inlet portion, an inlet shutter, and a locking member. The toner cartridge including a discharge shutter located in or coupled to a body and to switch to a closed position at which a first toner discharge portion of the body is closed and to switch to a discharge position at which the first toner discharge portion is open. The toner cartridge is rotatable about a first rotation axis. The first toner inlet portion is provided in the installation portion to receive toner from the toner cartridge. The inlet shutter is provided in the installation portion to switch to an inflow position at which the first toner inlet portion is open, from a blocked position at which the first toner inlet portion is blocked, by a first rotation of the toner cartridge from an installation position to a first angular position The locking member is provided in the toner cartridge and to lock the discharge shutter at the closed position during the first rotation of the toner cartridge.

15 Claims, 16 Drawing Sheets

(52) U.S. Cl.
CPC ..... *G03G 2215/0692* (2013.01); *G03G 2215/0872* (2013.01); *G03G 2221/1654* (2013.01)

(58) Field of Classification Search
CPC ... G03G 2215/0673; G03G 2215/0675; G03G 2215/0692; G03G 2221/1654
See application file for complete search history.

(56) References Cited

U.S. PATENT DOCUMENTS

| | | | |
|---|---|---|---|
| 6,212,338 | B1 | 4/2001 | Hagihara et al. |
| 6,269,234 | B1 | 7/2001 | Kurz et al. |
| 6,332,065 | B1 | 12/2001 | Howard |
| 7,574,160 | B2 | 8/2009 | Jung et al. |
| 7,668,489 | B2 | 2/2010 | Kim et al. |
| 2014/0227008 | A1 | 8/2014 | Janssen |
| 2017/0153575 | A1 | 6/2017 | Schulkes et al. |

* cited by examiner

【Figure 1】
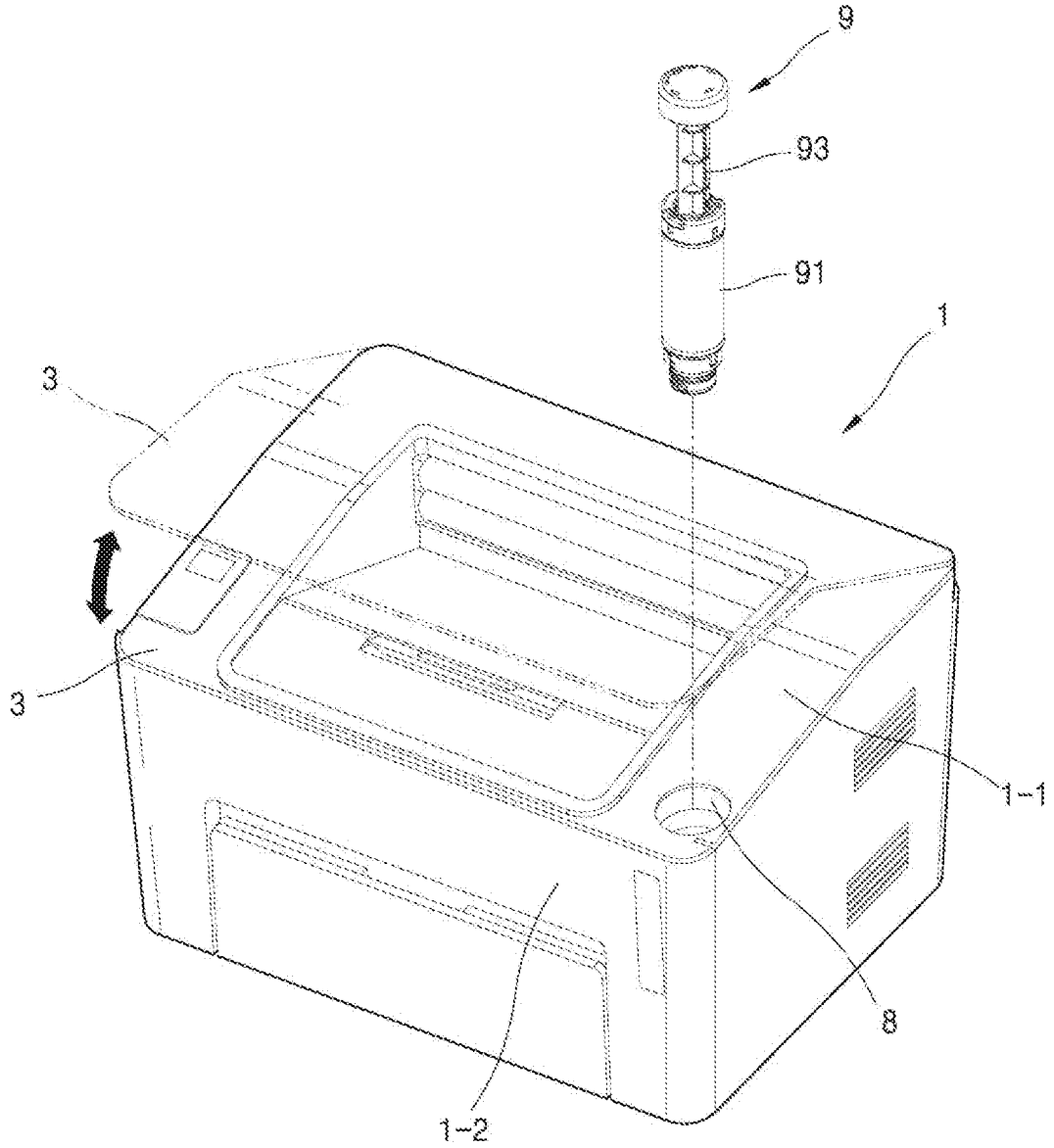

【Figure 2】
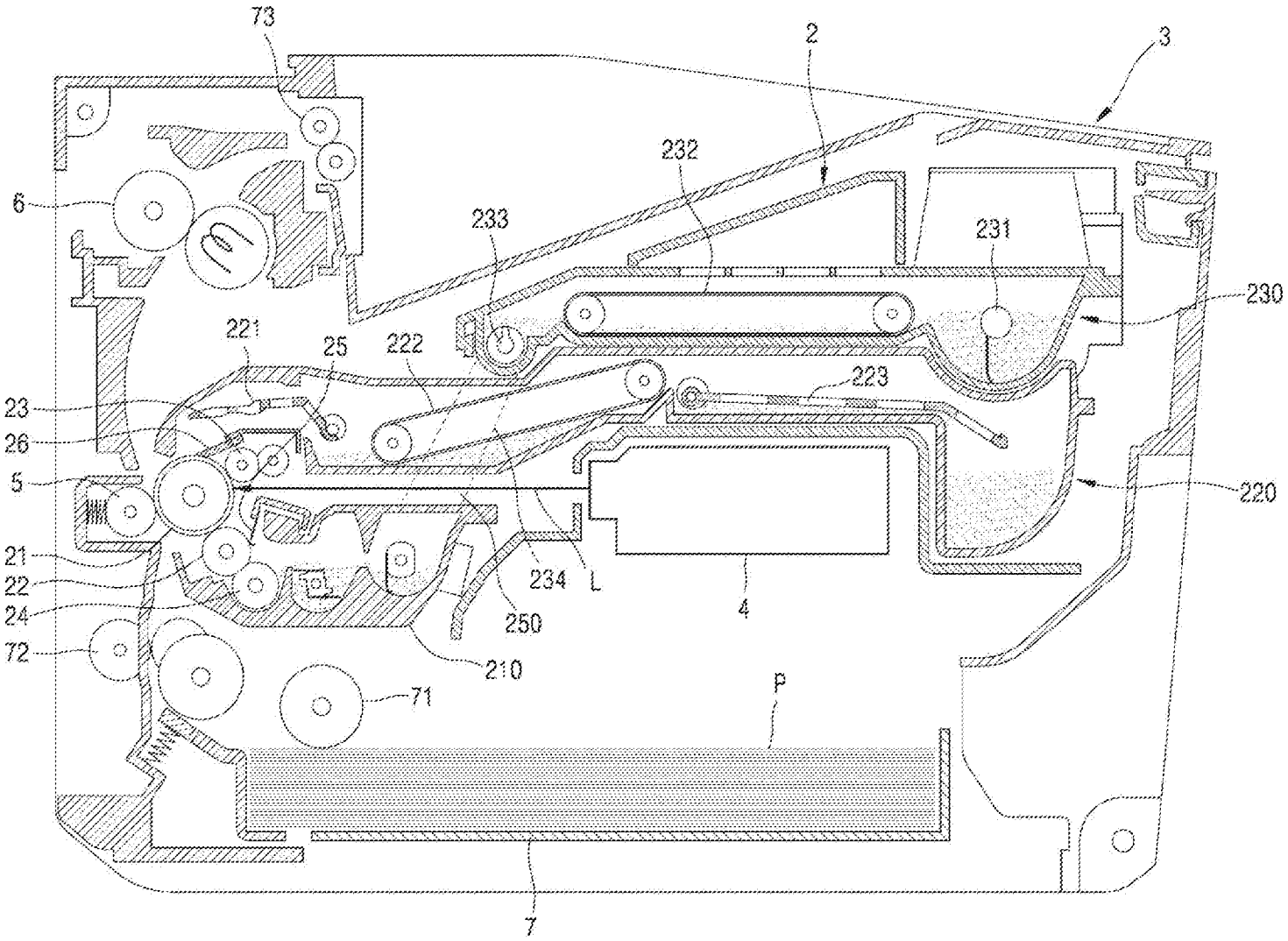

【Figure 3】
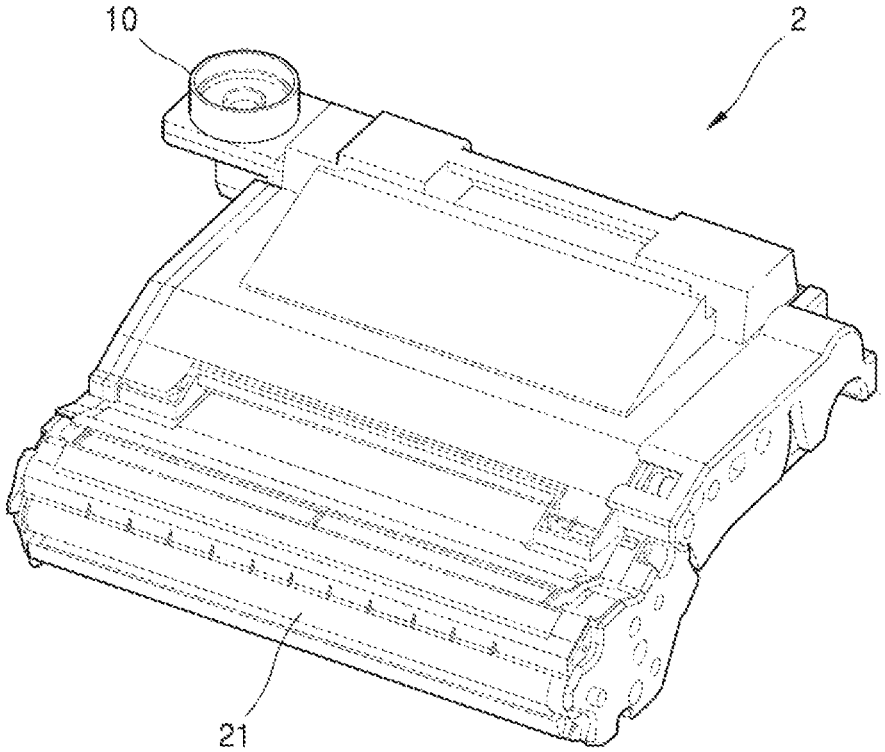

【Figure 4】
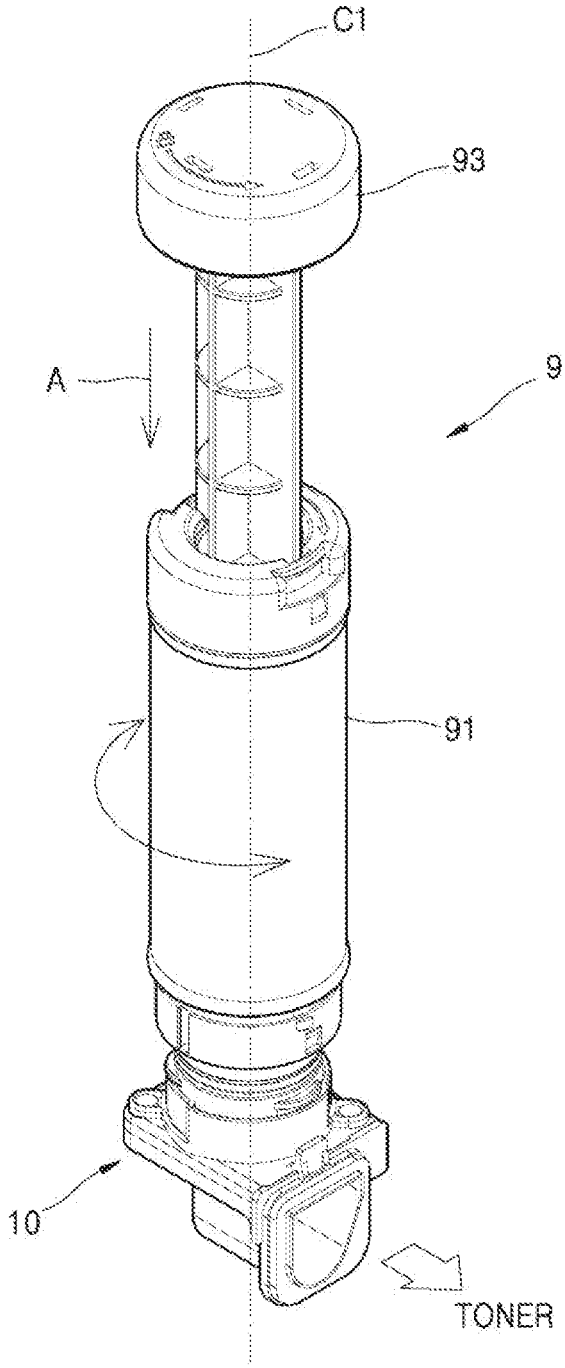

【Figure 5】
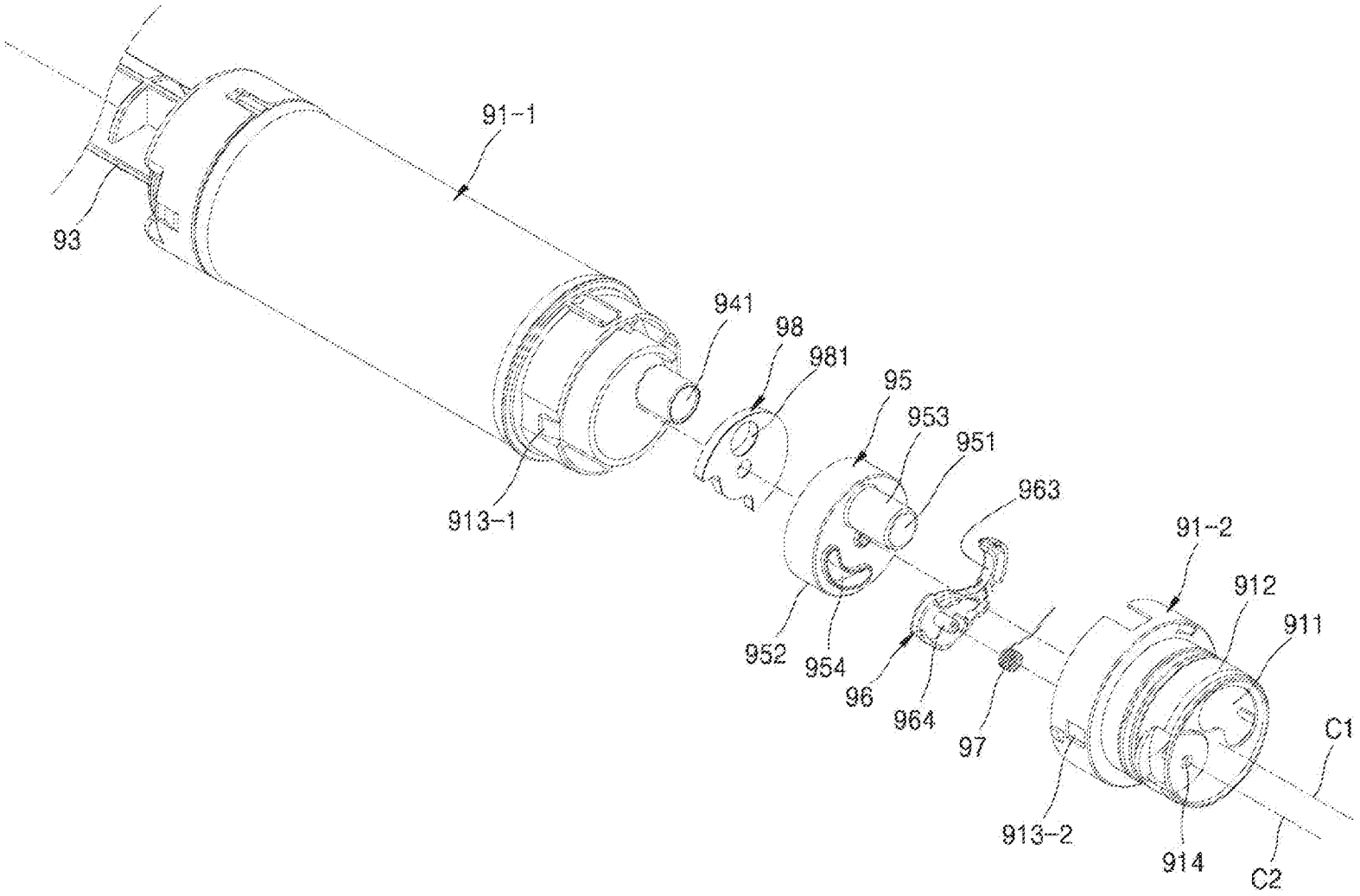

【Figure 6】
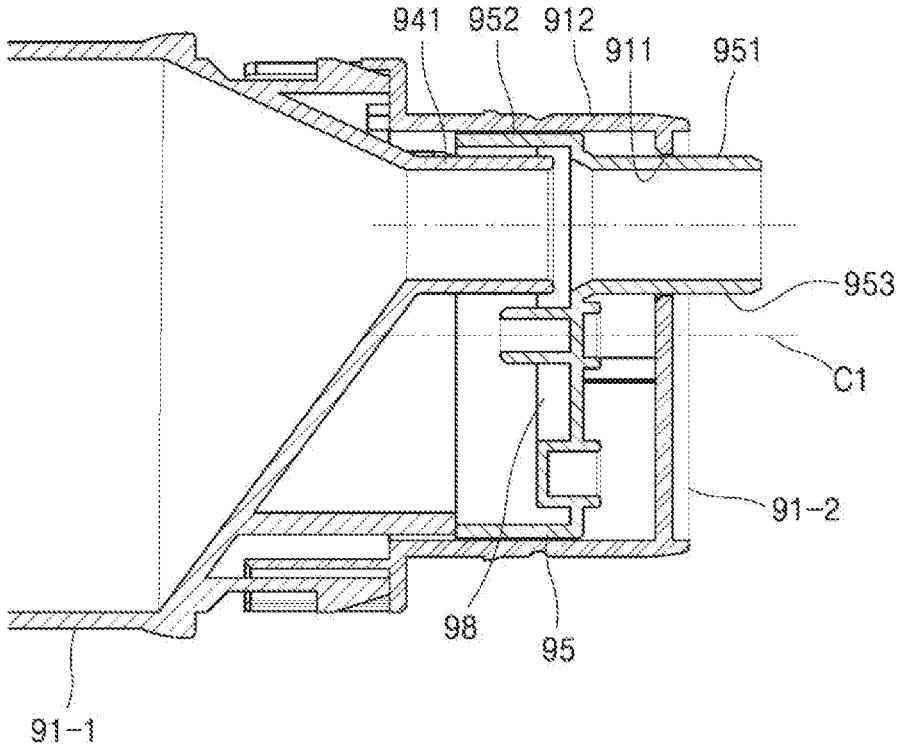
【Figure 7】
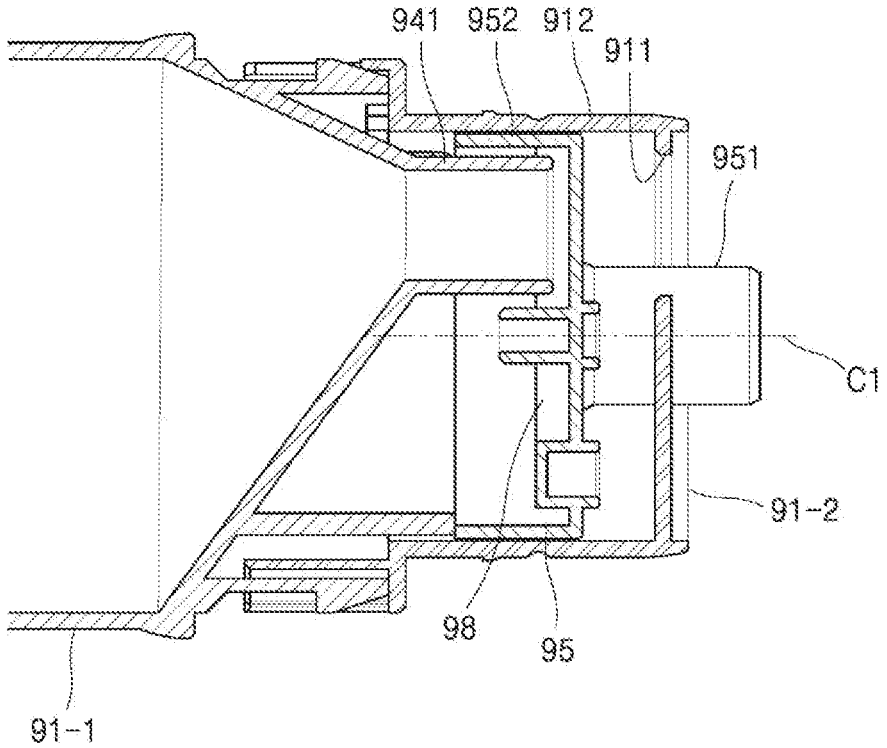

【Figure 8】
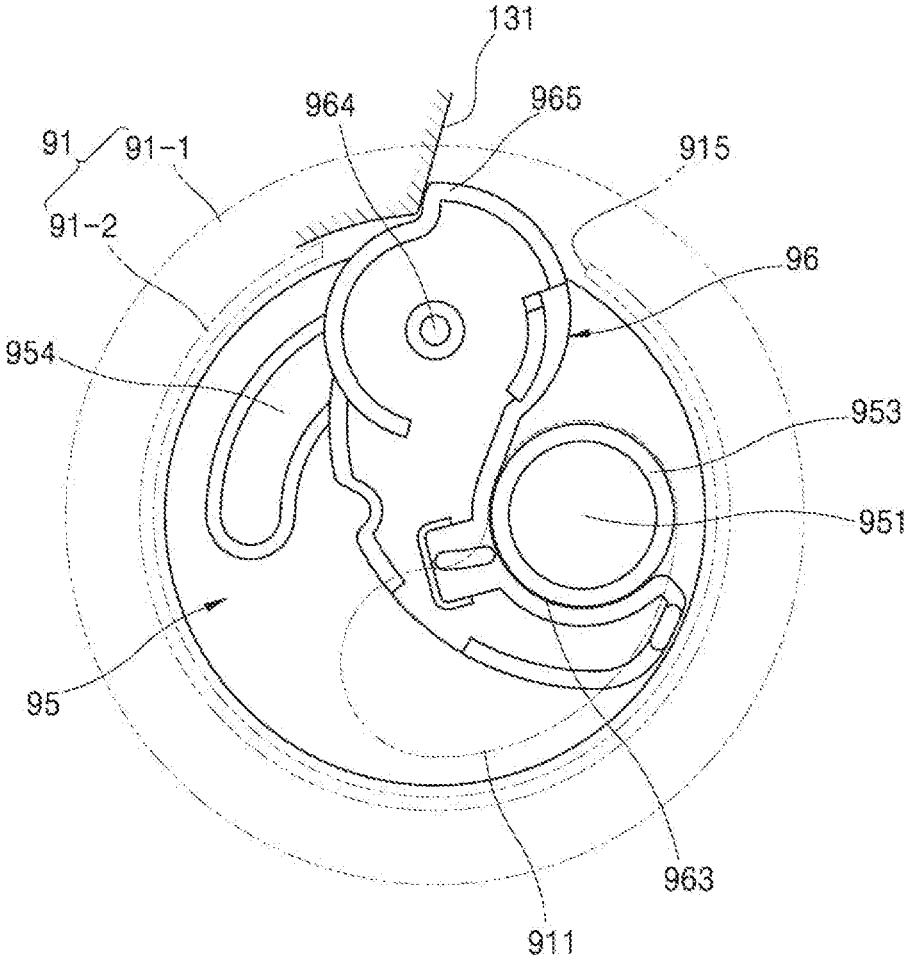

【Figure 9】
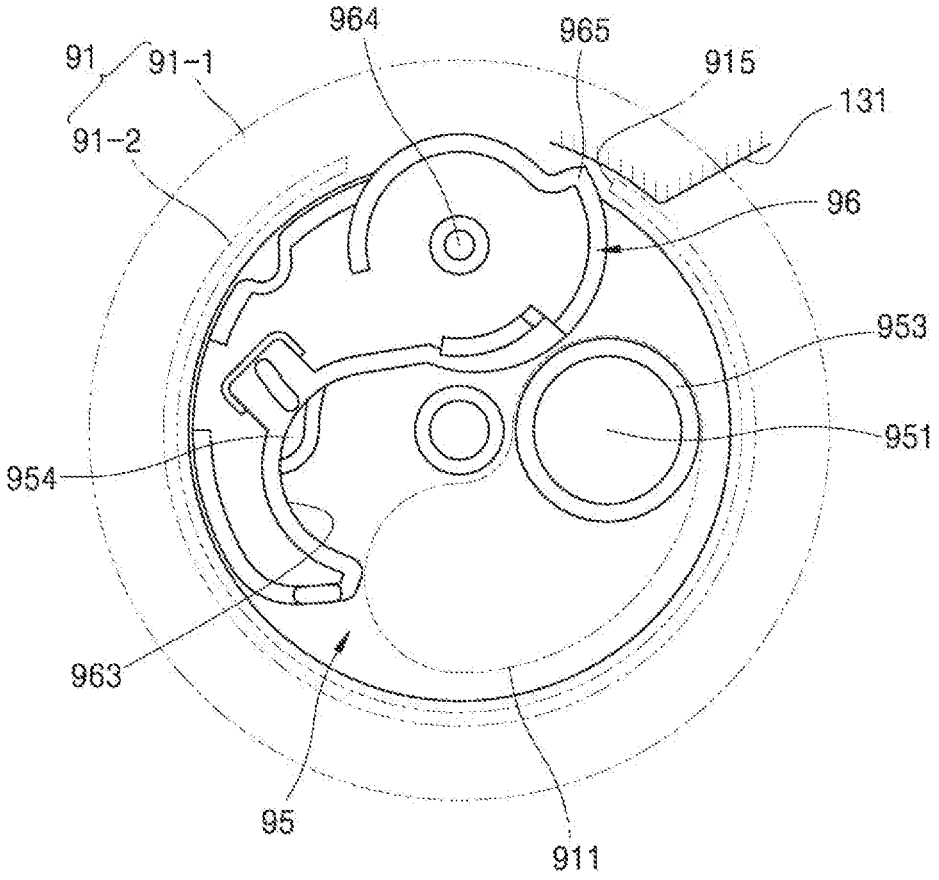

【Figure 10】
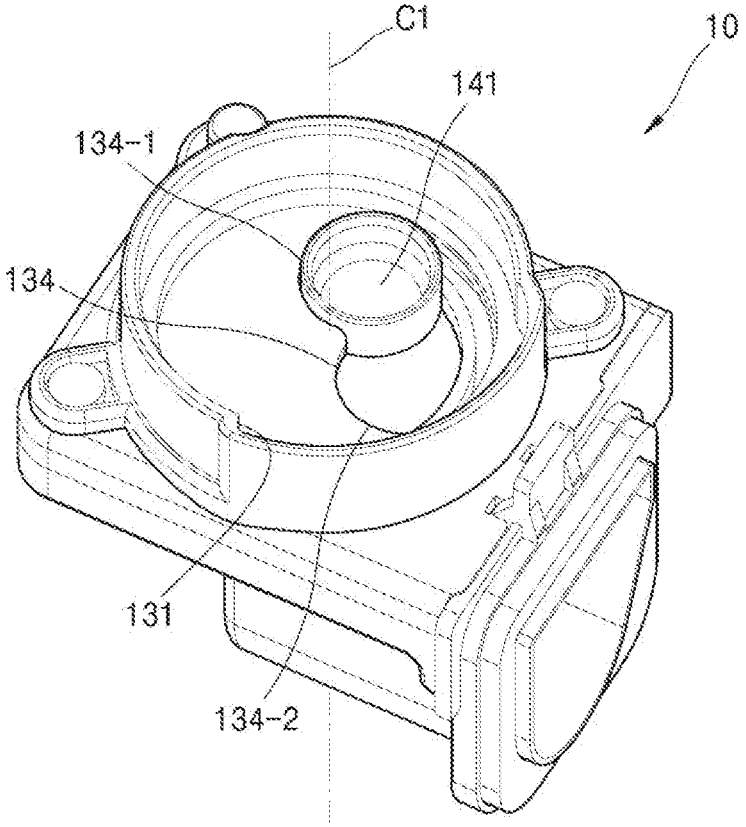

【Figure 11】
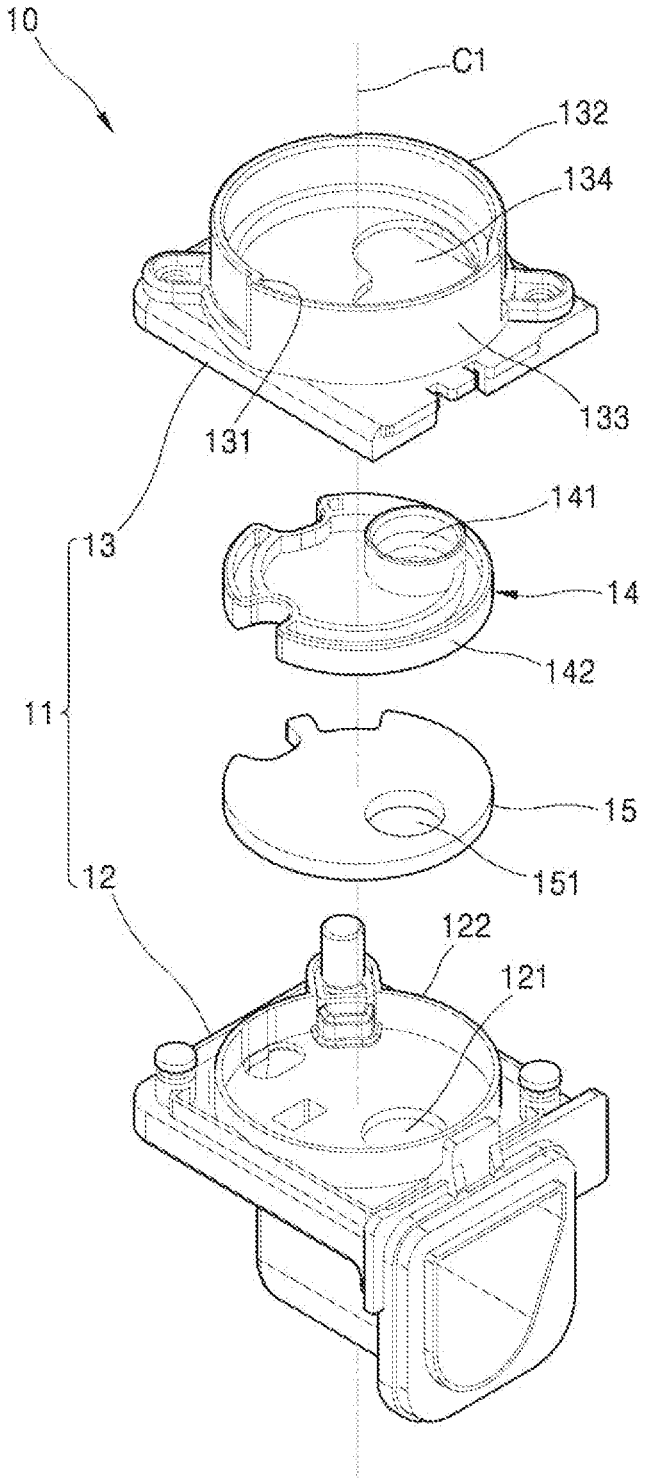

【Figure 12】
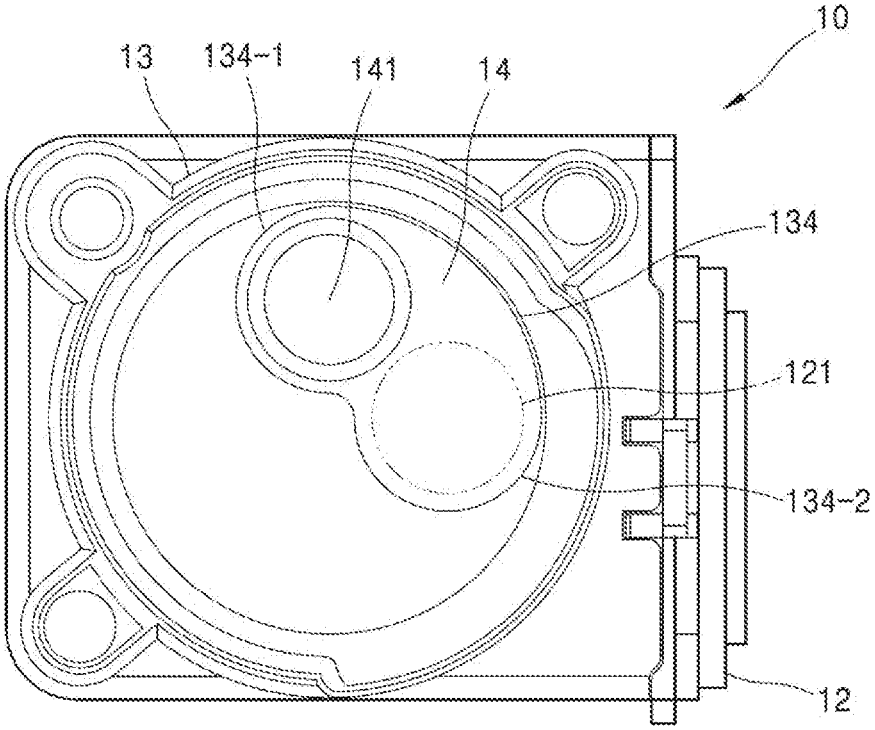
【Figure 13】
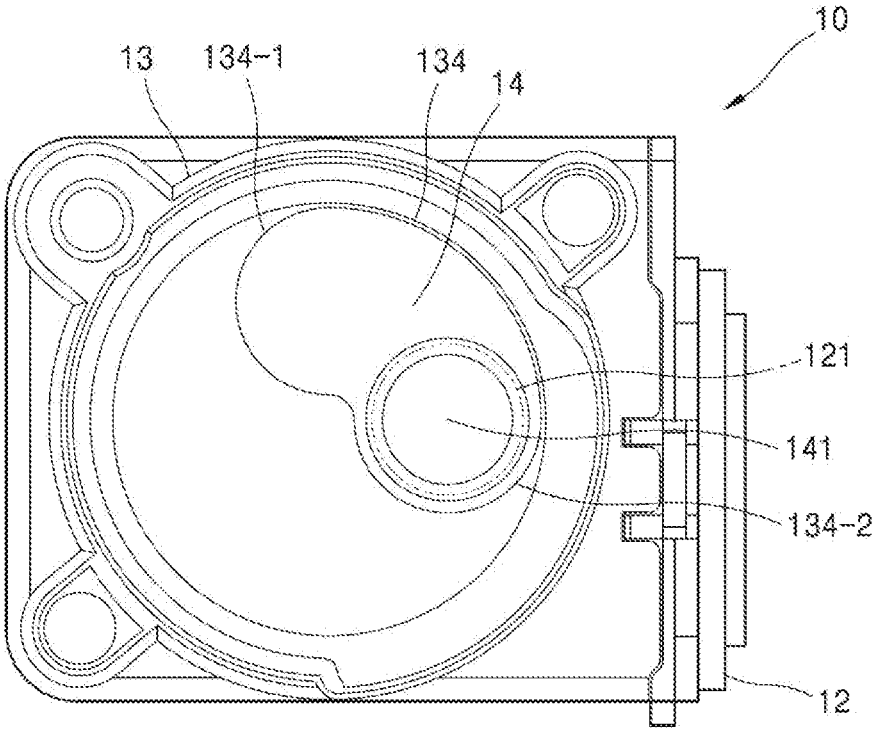

【Figure 14】
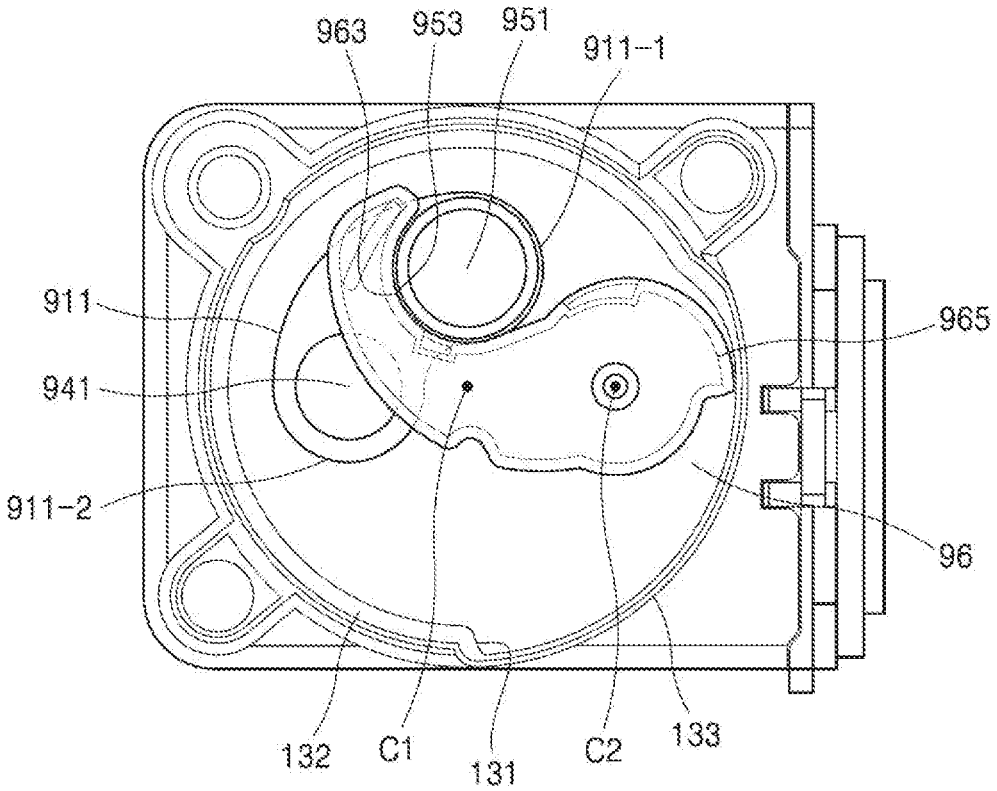
【Figure 15】
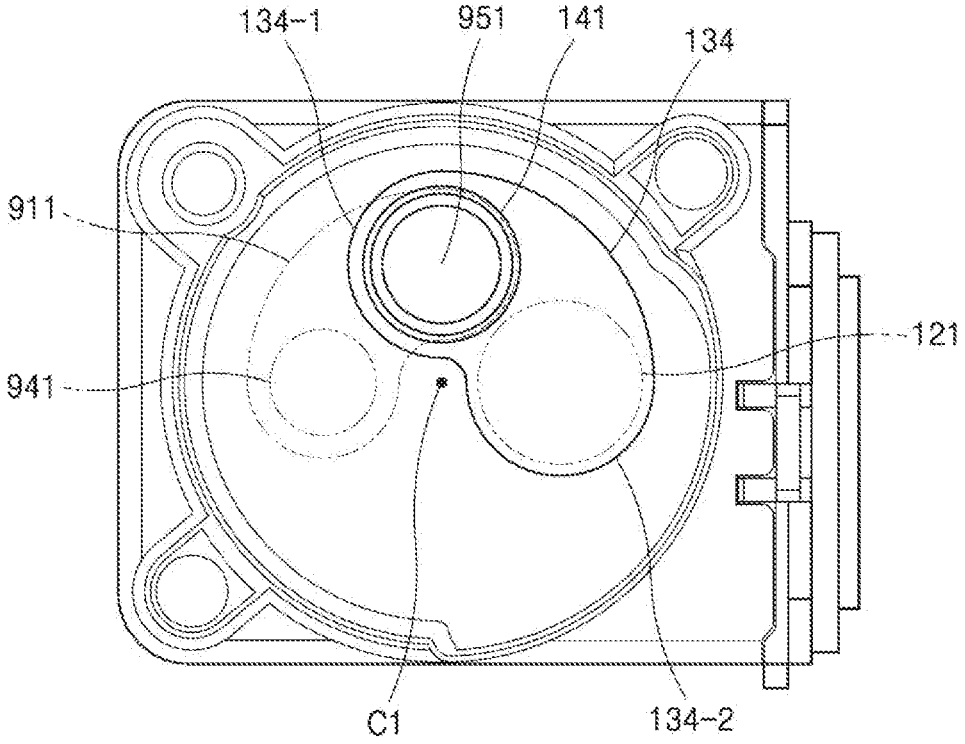

【Figure 16】
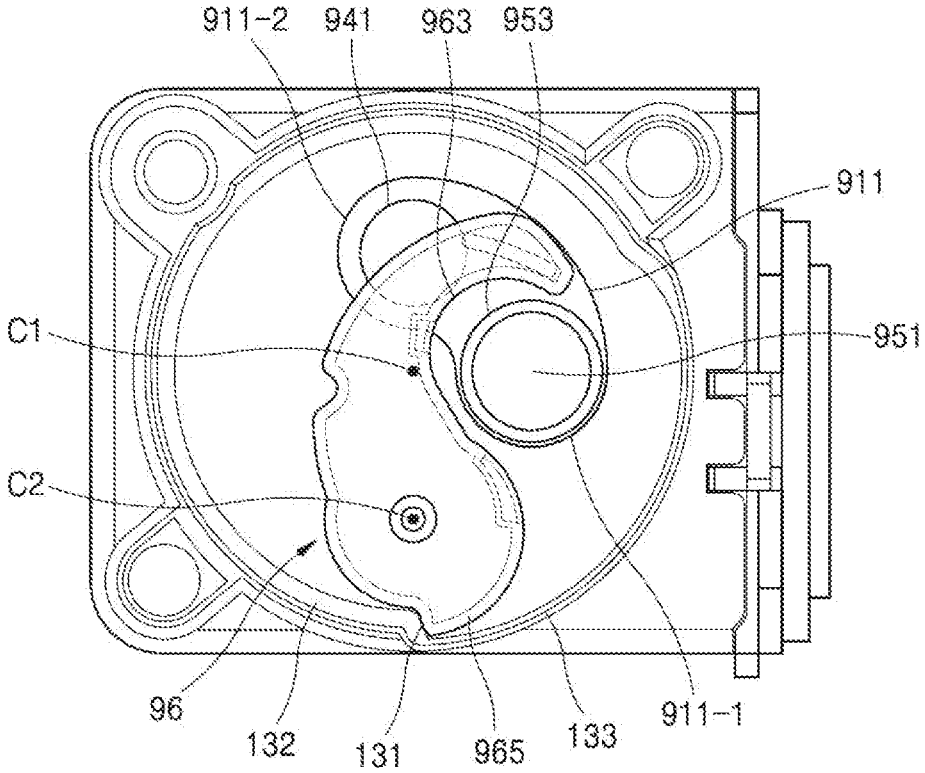
【Figure 17】
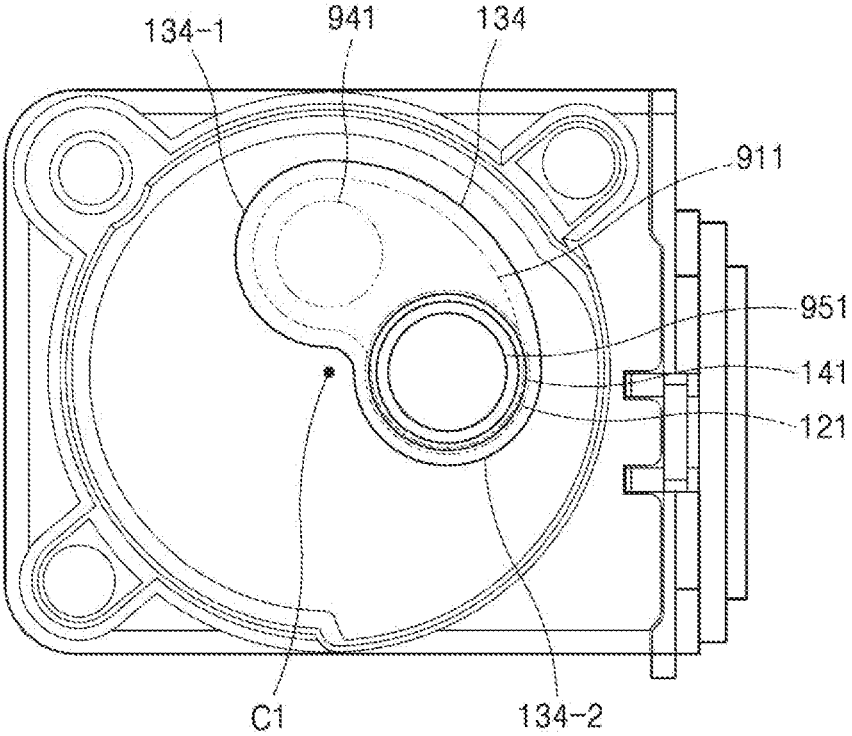

【Figure 18】
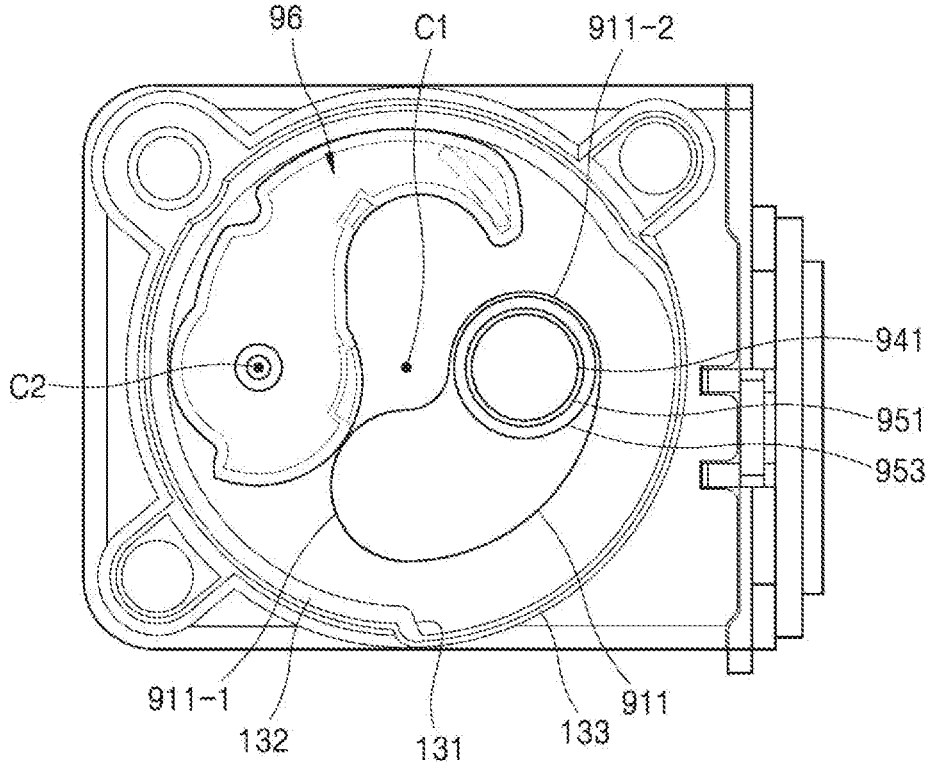
【Figure 19】
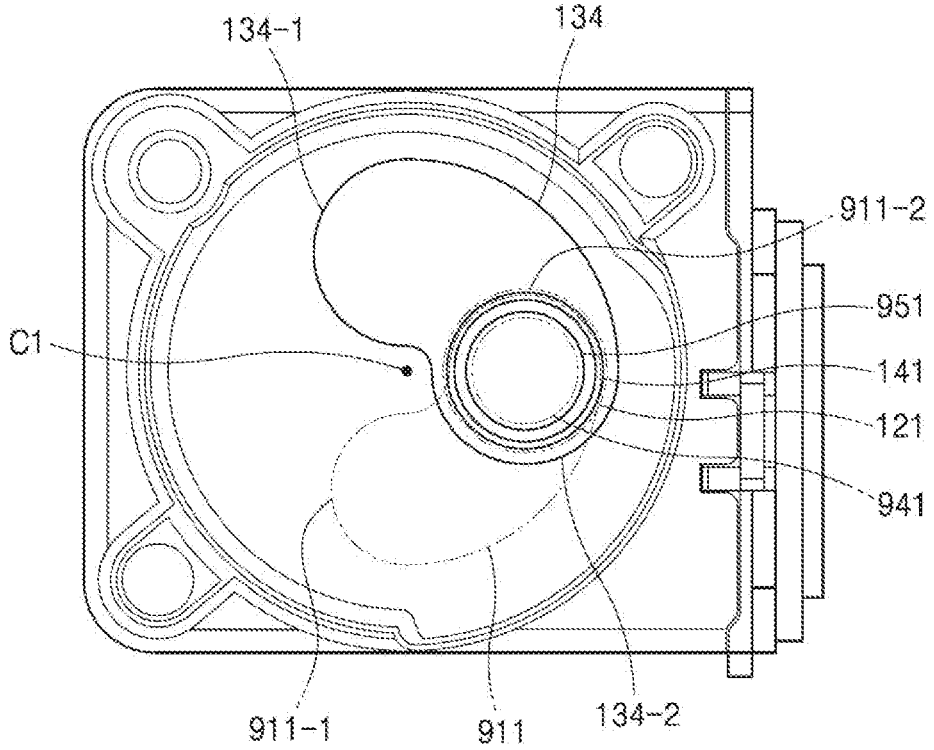

【Figure 20】
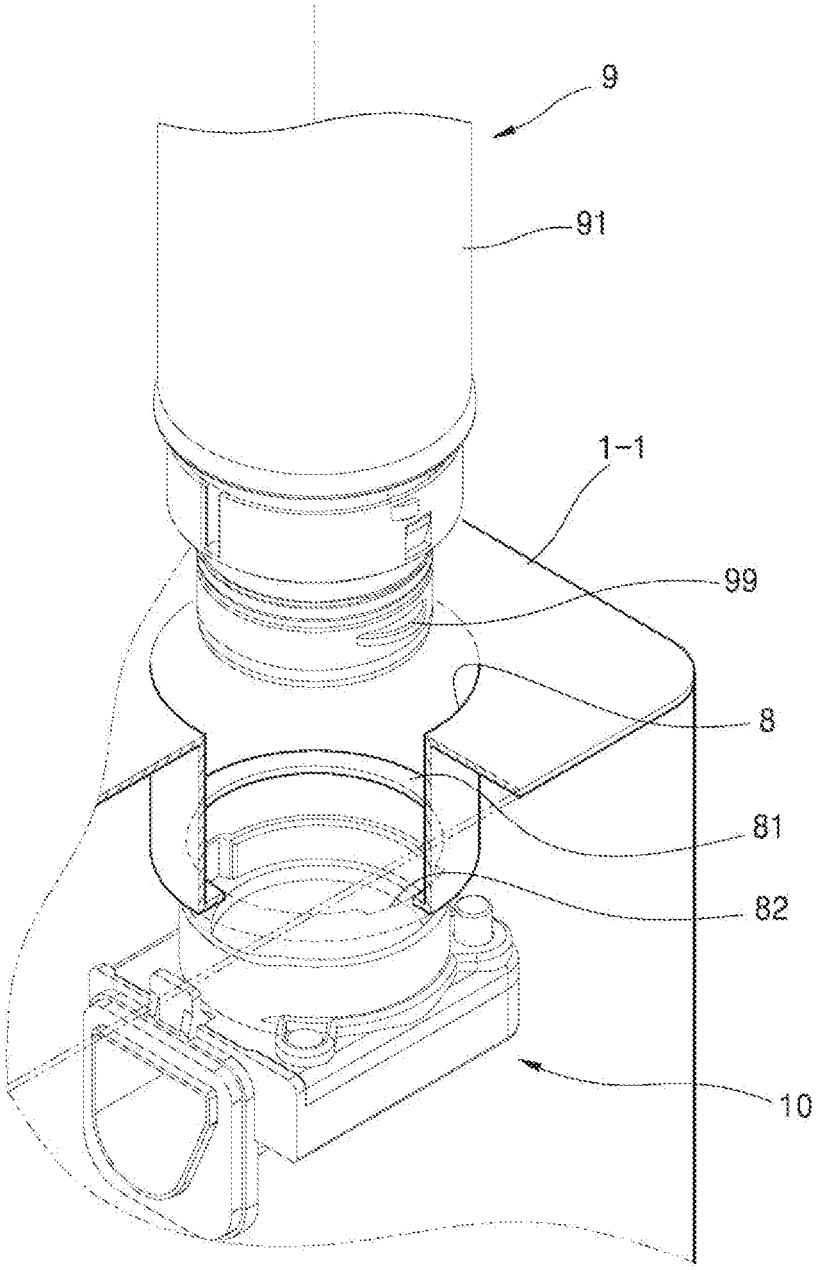

【Figure 21】
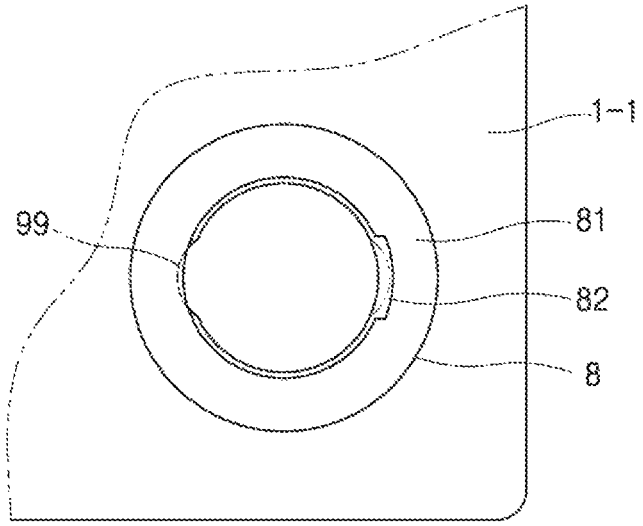

INTERFACE STRUCTURE FOR TONER REFILL CARTRIDGE AND TONER REFILL PORTION

CROSS REFERENCE TO RELATED APPLICATIONS

This application is a U.S. National Stage Application which claims the benefit under 35 U.S.C. § 371 of International Patent Application No. PCT/KR2018/016416 filed on Dec. 21, 2018, which claims priority from Korean Application No. 10-2018-0102557 filed on Aug. 30, 2018, the contents of each of which are incorporated herein by reference in their entireties.

BACKGROUND ART

Printers using an electrophotographic method form a visible toner image on a photoconductor by supplying toner to an electrostatic latent image formed on the photoconductor, transfer the toner image to a print medium via an intermediate transfer medium or directly transfer the toner image to the print medium, and then fix the transferred toner image on the print medium.

A development cartridge accommodates toner, and the toner from the development cartridge is supplied to an electrostatic latent image formed on a photoconductor, thereby forming a visible toner image. When the toner accommodated in the development cartridge is consumed, the development cartridge is detached from a main body of a printer, and a new development cartridge may be installed in the main body. The development cartridge may be refilled with new toner by using a toner refilling kit (toner refilling cartridge).

DESCRIPTION OF DRAWINGS

FIG. 1 is a schematic appearance perspective view illustrating an example of an electrophotographic printer;

FIG. 2 is a schematic configurational view of the example of the electrophotographic printer illustrated in FIG. 1;

FIG. 3 is a perspective view of an example of a development cartridge used in the example of the electrophotographic printer illustrated in FIG. 1;

FIG. 4 is a perspective view of an example of a toner refilling interface structure;

FIG. 5 is an exploded perspective view of an example of a toner cartridge;

FIG. 6 is a partial cross-sectional view illustrating a state in which a discharge shutter is located at a discharge position;

FIG. 7 is a partial cross-sectional view illustrating a state in which a discharge shutter is located at a closed position;

FIG. 8 is a front view illustrating a state in which a locking member is located at a locked position;

FIG. 9 is a front view illustrating a state in which a locking member is located at an unlocked position;

FIG. 10 is a perspective view of an example of a toner refilling portion;

FIG. 11 is an exploded perspective view of an example of a toner refilling portion;

FIG. 12 illustrates a state in which an inlet shutter is located at a blocked position;

FIG. 13 illustrates a state in which an inlet shutter is located at an inflow position;

FIG. 14 illustrates a positional relationship among a first toner discharge portion, a second toner discharge portion, and a locking member in a state in which a toner cartridge is located at an installation position;

FIG. 15 illustrates a positional relationship among a second toner discharge portion, a second toner inlet portion, and a first toner inlet portion in a state in which a toner cartridge is located at an installation position;

FIG. 16 illustrates a positional relationship among a first toner discharge portion, a second toner discharge portion, and a locking member in a state in which a toner cartridge is located at a first angular position;

FIG. 17 illustrates a positional relationship among a second toner discharge portion, a second toner inlet portion, and a first toner inlet portion in a state in which a toner cartridge is located at a first angular position;

FIG. 18 illustrates a positional relationship among a first toner discharge portion, a second toner discharge portion, and a locking member in a state in which a toner cartridge is located at a second angular position;

FIG. 19 illustrates a positional relationship among a second toner discharge portion, a second toner inlet portion, and a first toner inlet portion in a state in which a toner cartridge is located at a second angular position;

FIG. 20 is a perspective view illustrating an example of a separation preventing portion; and FIG. 21 is a plan view illustrating an example of a separation prevention portion.

MODE FOR INVENTION

FIG. 1 is a schematic appearance perspective view illustrating an example of an electrophotographic printer. FIG. 2 is a schematic configurational view of the example of the electrophotographic printer illustrated in FIG. 1. FIG. 3 is a perspective view of an example of a development cartridge used in the example of the electrophotographic printer illustrated in FIG. 1. Referring to FIGS. 1, 2, and 3, the electrophotographic printer may include a main body 1, and a development cartridge 2 detachably installed in the main body 1. A door 3 may be provided in the main body 1. The door 3 partially opens or closes the main body 1. Although FIG. 1 illustrates that the door 3 is configured to open an upper portion of the main body 1, the door 3 may also be configured, if needed, to open a side portion or a front portion of the main body 1. After the door 3 is open, the development cartridge 2 may be installed/detached at/from the main body 1.

A photosensitive drum 21 is an example of a photoconductor on which an electrostatic latent image is formed and may include a cylindrical metal pipe and a photosensitive layer that is formed on an outer circumferential surface of the cylindrical metal pipe and has photoconductivity. A charging roller 23 is an example of a charger for charging a surface of the photosensitive drum 21 with uniform electric potential. A charging bias voltage is applied to the charging roller 23. A corona charger (not shown) may also be used instead of the charging roller 23. A developing roller 22 supplies toner to an electrostatic latent image formed on the surface of the photosensitive drum 21 and develops the image.

In the case of a two-component developing method wherein toner and carrier are used as a developer, the developing roller 22 may be in a form in which a magnet is fixedly installed in a rotating sleeve. The sleeve may be placed apart at a distance of several tens to several hundreds of micrometers from the photosensitive drum 21. The carrier is attached to an outer circumference of the developing roller 22 by a magnetic force of the magnet, and the toner is attached to the carrier by electrostatic force, thereby forming a magnetic brush formed of the carrier and the toner on the outer circumference of the developing roller 22. The toner is transferred onto the electrostatic latent image formed on the photosensitive drum 21 by a developing bias voltage applied to the developing roller 22.

In the case of a one-component developing method wherein toner is used as a developer, the developing roller 22 may come into contact with the photosensitive drum 21, and may also be placed apart at a distance of several tens to several hundreds of micrometers from the photosensitive drum 21. In the present example, a one-component contact developing method, in which the developing roller 22 and the photosensitive drum 21 come into contact with each other, thus forming a development nip, is used. The developing roller 22 may be in a form in which an elastic layer (not shown) is formed on an outer circumference of a conductive metal core (not shown). When a developing bias voltage is applied to the developing roller 22, toner is transferred and attached to the electrostatic latent image formed on the surface of the photosensitive drum 21 via the development nip.

A supply roller 24 attaches toner to the developing roller 22. To attach toner to the developing roller 22, a supply bias voltage may be applied to the supply roller 24. Reference numeral 25 denotes a regulator configured to regulate the amount of toner attached to a surface of the developing roller 22. The regulator 25 may be, for example, a regulating blade, a tip end of which comes into contact with the developing roller 22 by a predetermined pressure. Reference numeral 26 denotes a cleaning member configured to remove residual toner and foreign matter from the surface of the photosensitive drum 21 before charging. The cleaning member 26 may be, for example, a cleaning blade, a tip end of which comes into contact with the surface of the photosensitive drum 21. Hereinafter, the foreign matter removed from the surface of the photosensitive drum 21 is referred to as waste toner.

An optical scanner 4 scans light modulated in accordance with image information onto the surface of the photosensitive drum 21 charged with uniform electric potential. The optical scanner 4 may be, for example, a laser scanning unit (LSU) configured to deflect light emitted from a laser diode in a main scanning direction by using a polygon mirror and scan the deflected light onto the photosensitive drum 21.

A transfer roller 5 is an example of a transfer unit placed opposite the photosensitive drum 21 and configured to form a transfer nip. A transfer bias voltage is applied to the transfer roller 5 so as to transfer a toner image developed on the surface of the photosensitive drum 21 to a print medium P. Instead of the transfer roller 5, a corona transfer unit may also be used.

The toner image, which is transferred to a surface of the print medium P by the transfer roller 5, is maintained on the surface of the print medium P by electrostatic attraction. A fuser 6 fixes the toner image onto the print medium P by applying heat and pressure thereto, thus forming a permanent printed image on the print medium P.

Referring to FIGS. 2 and 3, the development cartridge 2 of the present example includes a developing portion 210 in which the photosensitive drum 21 and the developing roller 22 are installed, a waste toner container 220 configured to accommodate waste toner removed from the photosensitive drum 21, and a toner container 230 connected to the developing portion 210 and configured to accommodate toner. To refill the toner container 230 with toner, the development cartridge 2 includes the toner refilling portion 10 connected to the toner container 230. The toner refilling portion 10 provides an interface between the toner cartridge 9, which will be described below, and the development cartridge 2. The development cartridge 2 is an integrated-type development cartridge including the developing portion 210, the waste toner container 220, the toner container 230, and the toner refilling portion 10.

A portion of an outer circumference of the photosensitive drum 21 is exposed to the outside of a housing. The exposed portion of the photosensitive drum 21 comes into contact with the transfer roller 5, thereby forming a transfer nip. The developing portion 210 may include at least one conveying member configured to convey toner towards the developing roller 22. The conveying member may also serve to charge toner with a predetermined electric potential by stirring the toner.

The waste toner container 220 is located on an upper side of the developing portion 210. The waste toner container 220 is spaced apart from the developing portion 210 in an upward direction, and a light path 250 is formed therebetween. The waste toner, which is removed from the photosensitive drum 21 by the cleaning member 26, is accommodated in the waste toner container 220. The waste toner removed from the surface of the photosensitive drum 21 is transported into the waste toner container 220 by at least one of the waste toner transporting members 221, 222, and 223. The type and number of waste toner transporting members are not particularly limited. According to the volume or type of the waste toner container 220, an appropriate number of waste toner transporting members may be installed at an appropriate position allowing waste toner to be effectively dispersed in the waste toner container 220.

The toner container 230 is connected to the toner refilling portion 10 to accommodate toner. As illustrated by dotted lines in FIG. 2, the toner container 230 is connected to the developing portion 210 via a toner supply unit 234. As illustrated in FIG. 2, the toner supply unit 234 may be connected to the developing portion 210 by passing through the waste toner container 220 vertically. The toner supply unit 234 is placed outside an effective width of an exposed light L so as not to interfere with the exposed light L scanned in a main scanning direction by the optical scanner 4.

The toner container 230 may be provided with at least one of the toner supply members 231, 232, and 233 configured to supply toner to the developing portion 210 via the toner supply unit 234. The type and number of toner supply members are not particularly limited. According to the volume or type of the toner container 230, an appropriate number of toner supply members may be installed at an appropriate position in the toner container 230 so as to effectively supply toner to the developing portion 210. The toner supply member 233 may convey toner in a main scanning direction and transfer the toner to the toner supply unit 234.

An image forming process will now be briefly described using the above-described configurations. A charging bias is applied to the charging roller 23, and the photosensitive drum 21 is charged with uniform electric potential. The optical scanner 4 scans light modulated in response to image information to the photosensitive drum 21 to thereby form an electrostatic latent image on the surface of the photosensitive drum 21. The supply roller 24 attaches toner to the surface of the developing roller 22. The regulator 25 forms a toner layer having a uniform thickness on the surface of the developing roller 22. A developing bias voltage is applied to the developing roller 22. As the developing roller 22 is rotated, toner transported to a developing nip is transferred and attached onto the electrostatic latent image formed on the surface of the photosensitive drum 21 by the developing bias voltage, thereby forming a visible toner image on the surface of the photosensitive drum 21. The print medium P taken out of a loading tray 7 by a pickup roller 71 is transferred to a transfer nip configured such that the transfer roller 5 and the photosensitive drum 21 face each other, by a transporting roller 72. When a transfer bias voltage is applied to the transfer roller 5, the toner image is transferred onto the print medium P by electrostatic attraction. The toner image transferred onto the print medium P is fixed on the print medium P by receiving heat and pressure from the fuser 6, thus completing printing. The print medium P is discharged by a discharge roller 73. Toner that is not transferred onto the print medium P and remains on the surface of the photosensitive drum 21 is removed by the cleaning member 26.

As described above, the development cartridge 2 of the present example includes the toner refilling portion 10 for refilling toner. According to the printer of the present example, the development cartridge 2 may be refilled with toner in a state in which the development cartridge 2 is installed in the main body 1 without being detached from the main body 1.

Referring to FIG. 1, the main body 1 is provided with a communicating portion 8 allowing an access to the toner refilling portion 10 from the outside of the main body 1 in a state in which the development cartridge 2 is installed in the main body 1. For example, when the toner cartridge (toner refilling cartridge) 9, in which toner is accommodated, is inserted into the communicating portion 8, the toner cartridge 9 may be connected to the toner refilling portion 10. In this state, the toner container 230 may be refilled with the toner accommodated in the toner cartridge 9 via the toner refilling portion 10. The toner cartridge 9 is released from the communicating portion 8 after toner refilling is completed.

Since the toner container 230 may be refilled with toner via the toner refilling portion 10 by such a configuration, the replacement time of the development cartridge 2 may extend until the lifetime of the photosensitive drum 21 ends, thus reducing the printing costs per sheet of paper. Since toner refilling is performed in a state in which the development cartridge 2 is installed in the main body 1, user convenience may be enhanced.

The communicating portion 8 may be provided at a position close to a front portion 1-2 (see FIG. 1) of the main body 1. The front portion 1-2 is opposite to a user, and thus the user may easily access the communicating portion 8. Thus, a toner refilling operation may be easily performed via the communicating portion 8.

The communicating portion 8 may be provided at an upper surface 1-1 of the main body 1. The toner refilling portion 10 is located below the communicating portion 8. The communicating portion 8 and the toner refilling portion 10 may be aligned with respect to each other in upward and downward directions. The toner cartridge 9 may provide access to the toner refilling portion 10 via the communicating portion 8 from an upper side of the main body 1. For example, when the toner cartridge 9 is inserted into the communicating portion 8 from the upper side of the main body 1, the toner cartridge 9 may be connected to the toner refilling portion 10.

Hereinafter, examples of an interface structure between the toner cartridge 9 and the toner refilling portion 10 will be described with reference to FIGS. 4 to 13.

FIG. 4 is a perspective view of an example of a toner refilling interface structure. FIG. 5 is an exploded perspective view of an example of the toner cartridge 9. FIG. 6 is a partial cross-sectional view illustrating a state in which a discharge shutter 95 is located at a discharge position. FIG. 7 is a partial cross-sectional view illustrating a state in which the discharge shutter 95 is located at a closed position. FIG. 8 is a front view illustrating a state in which a locking member 96 is located at a locked position. FIG. 9 is a front view illustrating a state in which the locking member 96 is located at an unlocked position. FIG. 10 is a perspective view of an example of the toner refilling portion 10. FIG. 11 is an exploded perspective view of an example of the toner refilling portion 10. FIG. 12 illustrates a state in which an inlet shutter 14 is located at a blocked position. FIG. 13 illustrates a state in which the inlet shutter 14 is located at an inflow position.

Referring to FIG. 4, the toner refilling interface structure includes the toner refilling portion 10 and the toner cartridge 9 installed at the toner refilling portion 10. As described above, the toner cartridge 9 may be installed at the toner refilling portion 10 via the communicating portion 8 provided in the main body 1. The toner cartridge 9 is installed at the toner refilling portion 10 and is rotated to a first angular position to a second angular position from an installation position.

This will be described below, and herein, definition of the installation position, the first angular position, and the second angular position will be briefly provided. The installation position refers to a position of the toner cartridge 9 in a state of being inserted into the main body 1 via the communicating portion 8 and installed at the toner refilling portion 10. The first angular position refers to a position at which the toner cartridge 9 is rotated by a first angle from the installation position. The second angular position refers to a position at which the toner cartridge 9 is rotated by a second angle from the first angular position. Rotation of the toner cartridge 9 from the installation position to the first angular position is referred to as a first rotation, and rotation of the toner cartridge 9 from the first angular position to the second angular position is referred to as a second rotation. At the installation position, the discharge shutter 95 of the toner cartridge 9 is located at a closed position at which toner is not allowed to be discharged from a body 91, and the inlet shutter 14 of the toner refilling portion 10 is located at a blocked position not allowing toner to be introduced into the toner refilling portion 10. At the first angular position, the discharge shutter 95 is located at the closed position, and the inlet shutter 14 is located at an inflow position allowing toner to be introduced into the toner refilling portion 10. At the second angular position, the discharge shutter 95 is located at a discharge position allowing toner to be discharged from the body 91, and the inlet shutter 14 is located at the inflow position.

As illustrated in FIG. 4, the toner cartridge 9 may be a syringe-type toner refilling cartridge including the body 91 in which toner is accommodated, and a plunger 93 movably coupled to the body 91 in a longitudinal direction A so as to push the toner to the outside of the body 91. When the plunger 93 is pressed in the longitudinal direction A in a state in which the toner cartridge 9 is installed at the toner refilling portion 10, the toner may be supplied to the toner container 230 of the development cartridge 2 from the body 91 via the toner refilling portion 10.

Referring to FIG. 5, the toner cartridge 9 may include the body 91, the discharge shutter 95, and the locking member 96. The body 91 contains toner, and includes a first toner discharge portion 941 configured to discharge toner. The first toner discharge portion 941 may be eccentrically located with respect to a first rotation axis C1. The body 91 may have, for example, a cylindrical shape. The first rotation axis C1 may be a central axis of the body 91 having a cylindrical shape. The first rotation axis C1 may be a rotation central axis when the toner cartridge 9 is installed at the toner refilling portion 10 and rotated.

In one example, the body 91 may include a first body 91-1 having toner accommodated therein and provided with the first toner discharge portion 941, and a second body 91-2 coupled to the first body 91-1 such that the discharge shutter 95 is disposed therebetween. The second body 91-2 may be coupled to a tip end portion of the first body 91-1. For example, the first body 91-1 may be snap-fit coupled to the second body 91-2. For this, a hook 913-1 may be provided at the first body 91-1 and a locking groove 913-2 caught by the hook 913-1 may be provided at the second body 91-2. The first toner discharge portion 941 may be in a form extending from the first body 91-1 to the discharge shutter 95.

The discharge shutter 95 may include a second toner discharge portion 951. The discharge shutter 95 is installed in the body 91 such that the discharge shutter 95 switches to a closed position at which the first toner discharge portion 941 is closed and to a discharge position at which the first toner discharge portion 941 is open. In one example, the discharge shutter 95 may be rotated relative to the body 91 about the first rotation axis C1 to a discharge position (see FIG. 6) at which the first toner discharge portion 941 is aligned with the second toner discharge portion 951 and to a closed position (see FIG. 7) at which the first toner discharge portion 941 is closed since the first toner discharge portion 941 is not aligned with the second toner discharge portion 951. The first toner discharge portion 941 and the second toner discharge portion 951 may be eccentrically located by the same distance radially from the first rotation axis C1. The discharge shutter 95 may be rotated relative to the body 91 about the first rotation axis C1 and thus switch to the closed position and the discharge position. When the plunger 93 is pressed in a state in which the discharge shutter 95 is located at the discharge position, toner inside the body 91 may be discharged outside of the body 91 via the first toner discharge portion 941 and the second toner discharge portion 951. Even when the plunger 93 is pressed in a state in which the discharge shutter 95 is located at the closed position, toner is unable to be discharged outside of the body 91 since the first toner discharge portion 941 is closed by the discharge shutter 95.

The discharge shutter 95 may be, for example, rotatably supported by the second body 91-2. For example, an outer support portion 912 having a cylindrical shape, based on the first rotation axis C1 may be provided in the second body 91-2, and an inner support portion 952 may be provided in the discharge shutter 95 such that the inner support portion 952 is rotatably supported by an inner side of the outer support portion 912.

A second rotation restricting portion may be provided in the toner cartridge 9. The second rotation restricting portion restricts the rotation of the body 91 relative to the discharge shutter 95 such that the body 91 is not rotated beyond the second angular position. For example, the second rotation restricting portion may be interfered by the second toner discharge portion 951 when the body is located at the second angular position, thus not allowing the body 91 to be rotated beyond the second angular position.

For example, the second toner discharge portion 951 may extend outward from the body 91 and thus protrude outside of the body 91. The second rotation restricting portion may be realized by a second slot 911 passing through the second body 91-2, allowing the second toner discharge portion 951 to protrude outside of the second body 91-2. The second slot 911 may have a shape that restricts a rotation angle of the body 91 relative to the discharge shutter 95. For example, the second slot 911 may have a circular arc shape based on the first rotation axis C1. One end portion and another end portion of the second slot 911 may respectively correspond to the closed position and discharge position of the discharge shutter 95. When the discharge shutter 95 reaches the closed position, the second toner discharge portion 951 is caught by the one end portion of the second slot 911. When the discharge shutter 95 reaches the discharge position, the second toner discharge portion 951 is caught by the other end portion of the second slot 911. Accordingly, the body 91 is no longer rotated relative to the discharge shutter 95.

A first sealing member 98 may be disposed between the first body 91-1 and the discharge shutter 95. The first sealing member 98 may be rotated relative to the body 91 along with the discharge shutter 95. A through-hole 981 aligned with the second toner discharge portion 951 is provided in the first sealing member 98. The first sealing member 98 closes the first toner discharge portion 941 between the closed position and discharge position of the discharge shutter 95. When the discharge shutter 95 is located at the discharge position, the first toner discharge portion 941, the through-hole 981, and the second toner discharge portion 951 may be aligned with respect to one another so that toner is discharged outside of the body 91. When the discharge shutter 95 escapes from the discharge position, the first toner discharge portion 941 is closed by the first sealing member 98. By adopting the first sealing member 98, toner leakage between the first body 91-1 and the discharge shutter 95 may be prevented.

The locking member 96 locks the discharge shutter 95 at the closed position during a first rotation of the toner cartridge 9, i.e., during rotation of the toner cartridge 9 from the installation position to the first angular position, which will be described below. For example, a first interference portion 953 may be provided in the discharge shutter 95. The locking member 96 may include a second interference portion 963 corresponding to the first interference portion 953. The locking member 96 is supported by the body 91 such that the locking member 96 is rotatable about a second rotation axis C2, which is different from the first rotation axis C1, to a locked position (see FIG. 8) at which the first interference portion 953 of the discharge shutter 95 located at the closed position is caught by the second interference portion 963, thereby not allowing the discharge shutter 95 to rotate and to an unlocked position (see FIG. 9) at which the discharge shutter 95 is allowed to rotate. A locking spring 97 applies an elastic force to the locking member 96 in a direction returning to the locked position from the unlocked position. The locking spring 97 applies an elastic force to the locking member 96 in a direction in which the discharge shutter 95 is locked at the closed position.

The locking member 96 may be rotated relative to the body 91 about the second rotation axis C2 and switch to the locked position and the unlocked position. The first interference portion 953 is caught by the second interference portion 963 in a state in which the locking member 96 is located at the locked position, and thus the discharge shutter 95 is unable to be rotated to the discharge position and is maintained at the closed position. The locking member 96 locks the discharge shutter 95 in a state of being located at the closed position before the toner cartridge 9 is installed at the toner refilling portion 10. Due to this, unintended toner leakage may be prevented. When the locking member 96 is located at the unlocked position, the second interference portion 963 is separated from the first interference portion 953, and the discharge shutter 95 may be rotated to the discharge position from the closed position.

In one example, the locking member 96 may include a support shaft 964 extending along the second rotation axis C2 and having an end portion rotatably supported by the second body 91-2. A support hole 914 through which the end portion of the support shaft 964 is inserted and by which the end portion thereof is rotatably support may be provided in the second body 91-2. A support portion 954 by which another end portion of the support shaft 964 is rotatably supported is provided in the discharge shutter 95. Since the discharge shutter 95 is rotated about the first rotation axis C1 to the closed position and the discharge position, this corresponds to a case in which the locking member 96 is rotated relative to the discharge shutter 95 about the first rotation axis C1. Thus, the support portion 954 may have a circular arc shape allowing relative rotation of the locking member 96 with respect to the first rotation axis C1. The support portion 954 supports the other end portion of the support shaft 964 such that the end portion of the support shaft 964 does not escape from the support hole 914. Due to such a configuration, a separate support member not allowing the end portion of the support shaft 964 to escape from the support hole 914 may not be adopted, and thus the toner cartridge 9 may have a simplified structure and the number of assembly processes is decreased, thus reducing cost of the toner cartridge 9.

The locking member 96 may include an external force receiver 965 exposed to the outside of the body 91 so as to receive an external force for switching to the unlocked position from the locked position. For example, a through groove 915 may be provided at a side portion of the second body 91-2, and the external force receiver 965 may be exposed to the outside of the second body 91-2 via the through groove 915. The external force receiver 965 may be interfered by a releasing portion 131 (see FIG. 11) provided in the toner refilling portion 10, for example, when the toner cartridge 9 is installed at the toner refilling portion 10. The toner cartridge 9 may be installed at the toner refilling portion 10 and rotated about the first rotation axis C1, and at this time, the external force receiver 965 may contact the releasing portion 131 (see FIG. 10) so that the locking member 96 switches to the unlocked position from the locked position.

The locking spring 97 may have various shapes, for example, a coil spring, a leaf spring, an elastic arm formed integrally with the locking member 96, and the like. In the present example, the locking member 96 is realized by a torsion coil spring having a central coil winding portion installed on the support shaft 964, an end portion supported by the locking member 96, and another end portion supported by the second body 91-2.

When the elastic force of the locking spring 97 is strong, the locking member 96 may be stably maintained at the locked position, but a great force may be needed to switch the locking member 96 to the unlocked position from the locked position. For example, a great force may be needed to rotate the toner cartridge after the toner cartridge 9 is installed at the toner refilling portion 10. On the other hand, when the elastic force of the locking spring 97 is weak, the locking member 96 may switch to the unlocked position from the locked position with a small force, but the locking member 96 may switch to the unlocked position by external impact or a small force.

The locking member 96 is rotated about the second rotation axis C2 different from the first rotation axis C1, which is a rotation axis of the discharge shutter 95. By appropriately determining the position of the second rotation axis C2, the elastic force of the locking spring 97 may be decreased and the locking member 96 may also be stably maintained at the locked position. In one example, the position of the second rotation axis C2 may be determined such that, when the discharge shutter 95 is rotated to the discharge position from the closed position in a state in which the locking member 96 is located at the locked position, a normal component based on the second rotation axis C2 of a rotational force applied to the second interference portion 963 by the first interference portion 953 is directed in a direction opposite to the second rotation axis C2. When the normal component is directed in a direction opposite to the second rotation axis C2, the normal component acts in a direction hindering rotation of the locking member 96 about the second rotation axis C2 to the unlocked position, and since the second interference portion 963 acts as a wedge, the locking member 96 is unable to be rotated to the unlocked position. Thus, even when external impact or vibration occurs in a state in which the discharge shutter 95 is located at the closed position, the discharge shutter 95 may be stably maintained at the closed position, and accordingly, toner leakage may be effectively prevented. Even in a structure in which the second toner discharge portion 951 protrudes outside of the body 91 and thus external force may act thereon, toner leakage may be effectively prevented. Since the locking spring 97 simply applies, to the locking member 96, an elastic force sufficient to switch to a locked position from the unlocked position, the elastic force of the locking spring 97 may be small. When the toner cartridge 9 is not installed at the toner refilling portion 10, a user is unable to arbitrarily switch the discharge shutter 95 to the discharge position, whereas, when the toner cartridge 9 is installed at the toner refilling portion 10, the locking member 96 may switch to the unlocked position even with a very small force, thereby switching the discharge shutter 95 to the discharge position.

Referring to FIGS. 10 and 11, the toner refilling portion 10 includes an installation portion 11 at which the toner cartridge 9 is installed, a first toner inlet portion 121, and the inlet shutter 14.

The installation portion 11 has a structure in which the toner cartridge 9 is allowed to be rotated with respect to the first rotation axis C1 in a state in which the toner cartridge 9 is installed at the installation portion 11. The first toner inlet portion 121 is provided in the installation portion 11 so as to receive toner from the toner cartridge 9. For example, when the toner cartridge 9 is installed at the installation portion 11 and the discharge shutter 95 is located at the discharge position, the first toner discharge portion 941, the second toner discharge portion 951, and the first toner inlet portion 121 are aligned with respect to one another, and thus toner may be supplied to the toner container 230 from the body 91 via the first toner discharge portion 941, the second toner discharge portion 951, and the first toner inlet portion 121.

For example, the installation portion 11 may include a lower body 12 and an upper body 13. The upper body 13 is coupled to the lower body 12. The upper body 13 has a structure by which the toner cartridge 9 is rotatably supported. For example, a first accommodating portion 132 configured to accommodate a tip end portion of the toner cartridge 9 and having a cylindrical shape is provided in the upper body 13. The first accommodating portion 132 may be realized by, for example, a cylindrical rib based on the first rotation axis C1 and protruding upward. The lower body 12 is connected to the toner container 230. The first toner inlet portion 121 is provided in the lower body 12.

A releasing portion 131 may be provided in the installation portion 11. The releasing portion 131 contacts the locking member 96 when the toner cartridge 9 is located at the first angular position, and thus the discharge shutter 95 is unlocked so that the body 91 is rotated relative to the discharge shutter 95 from the first angular position to the second angular position at which the first and second toner discharge portions 941 and 951 are aligned with respect to each other. For example, the first accommodating portion 132 partially expands outward in a radius direction, and accordingly, a second accommodating portion 133 having a greater diameter than that of the first accommodating portion 132 is formed. The diameter of the second accommodating portion 133 with respect to the first rotation axis C1 is determined such that the external force receiver 965 of the locking member 96 is not interfered therewith. The releasing portion 131 may be realized by a boundary between the first accommodating portion 132 and the second accommodating portion 133. The releasing portion 131 may contact the external force receiver 965 provided in the locking member 96.

The inlet shutter 14 is provided in the installation portion 11 such that the inlet shutter 14 may switch to a blocked position (see FIG. 12) at which the first toner inlet portion 121 is blocked and an inflow position (see FIG. 13) at the first toner inlet portion 121 is open. The inlet shutter 14 may be rotated with respect to the first rotation axis C1 to the blocked position and the inflow position. In one example, the inlet shutter 14 may include a second toner inlet portion 141 aligned with the second toner discharge portion 951. The inlet shutter 14 may be provided in the installation portion 11 such that the inlet shutter 14 is rotated about the first rotation axis C1 to the blocked position at which the first toner inlet portion 121 and the second toner inlet portion 141 are not aligned with respect to each other, thereby allowing the first toner inlet portion 121 to be closed and to the inflow position at which the first toner inlet portion 121 is aligned with the second toner inlet portion 141, thereby allowing the first toner inlet portion 121 to be open.

For example, the inlet shutter 14 may be located between the lower body 12 and the upper body 13. The inlet shutter 14 may be rotatably supported by the lower body 12. A first cylindrical portion 122 is provided in the lower body 12 and configured to rotatably support the inlet shutter 14 about the first rotation axis C1. The first cylindrical portion 122 may be realized by, for example, a cylindrical rib based on the first rotation axis C1 and protruding towards the upper body 13. The inlet shutter 14 is supported by the lower body 12 such that a second cylindrical portion 142 forming an outer circumference of the inlet shutter 14 is located inside the first cylindrical portion 122. The upper body 13 is coupled to the lower body 12 such that the upper body 13 covers the inlet shutter 14.

The inlet shutter 14 may switch to the inflow position from the blocked position by the first rotation of the toner cartridge 9. The second toner discharge portion 951 may be coupled to the second toner inlet portion 141. For example, the second toner discharge portion 951 may be inserted into the second toner inlet portion 141. In a state in which the discharge shutter 95 is locked at the closed position by the locking member 96, when the toner cartridge 9 is installed at the installation portion 11 and rotated about the first rotation axis C1, the second toner discharge portion 951 may push the second toner inlet portion 141, thereby rotating the inlet shutter 14 from the blocked position to the inflow position.

A first rotation restricting portion may be provided in the installation portion 11. When the toner cartridge 9 is located at the first angular position, the first rotation restricting portion is interfered by the second toner inlet portion 141 so that the inlet shutter 14 is not rotated beyond the first angular position. When the toner cartridge 9 is located at the first angular position, the first rotation restricting portion locks the discharge shutter 95 at the first angular position so that the discharge shutter 95 is not rotated beyond the first angular position. By using the first rotation restricting portion, a state in which the second toner discharge portion 951, the second toner inlet portion 141, and the first toner inlet portion 121 are aligned with respect to one another is maintained at the first angular position. In this state, when the locking member 96 switches to the unlocked position, the body 91 may be rotated relative to the discharge shutter 95 to the second angular position. At the second angular position, the discharge shutter 95 is located at the discharge position, and the first toner discharge portion 941, the second toner discharge portion 951, the second toner inlet portion 141, and the first toner inlet portion 121 are aligned with one another.

In one example, the first rotation restricting portion may be realized by a first slot 134 provided in the upper body 13. The first slot 134 passes through the upper body 13, allowing the second toner discharge portion 951 to be inserted therethrough. The second toner inlet portion 141 protrudes upward from the inlet shutter 14 and is inserted into the first slot 134. The second toner discharge portion 951 may be inserted into the second toner inlet portion 141. The first slot 134 may have a circular arc shape including a first end portion 134-1 and a second end portion 134-2 at which the second toner inlet portion 141 is located when the toner cartridge 9 is positioned at the installation position and the first angular position, respectively.

A second sealing member 15 may be disposed between the lower body 12 and the inlet shutter 14. The second sealing member 15 may be fixedly installed in the lower body 12. A through-hole 151 aligned with the first toner inlet portion 121 is provided in the second sealing member 15. The second sealing member 15 blocks the second toner inlet portion 141 between the blocked position and inflow position of the inlet shutter 14. When the inlet shutter 14 is located at the inflow position, the first toner inlet portion 121, the through-hole 151, and the second toner inlet portion 141 are aligned with respect to each other, and thus toner may be introduced into the first toner inlet portion 121 from the outside. When the inlet shutter 14 escapes from the inflow position, the second toner inlet portion 141 is blocked by the second sealing member 15. By using the second sealing member 15, toner leakage between the lower body 12 and the inlet shutter 14 may be prevented.

An example of a process of refilling the toner container 230 with toner by the above-described toner refilling interface structure will be briefly described. FIG. 14 illustrates a positional relationship among the first toner discharge portion 941, the second toner discharge portion 951, and the locking member 96 in a state in which the toner cartridge 9 is located at the installation position. FIG. 15 illustrates a positional relationship among the second toner discharge portion 951, the second toner inlet portion 141, and the first toner inlet portion 121 in a state in which the toner cartridge 9 is located at the installation position. FIG. 16 illustrates a positional relationship among the first toner discharge portion 941, the second toner discharge portion 951, and the locking member 96 in a state in which the toner cartridge 9 is located at the first angular position. FIG. 17 illustrates a positional relationship among the second toner discharge portion 951, the second toner inlet portion 141, and the first toner inlet portion 121 in a state in which the toner cartridge 9 is located at the first angular position. FIG. 18 illustrates a positional relationship among the first toner discharge portion 941, the second toner discharge portion 951, and the locking member 96 in a state in which the toner cartridge 9 is located at the second angular position. FIG. 19 illustrates a positional relationship among the second toner discharge portion 951, the second toner inlet portion 141, and the first toner inlet portion 121 in a state in which the toner cartridge 9 is located at the second angular position.

Until the toner cartridge 9 is installed at the toner refilling portion 10, the discharge shutter 95 is located at the closed position at which the first toner discharge portion 941 and the second toner discharge portion 951 are not aligned with respect to each other. The locking member 96 is located at the locked position, thus locking the discharge shutter 95 at the closed position. Accordingly, toner leakage may be prevented.

The toner cartridge 9 is inserted into the main body 1 via the communicating portion 8 of the main body 1. Then, as illustrated in FIG. 14, the tip end portion of the toner cartridge 9 is accommodated in the first accommodating portion 132 of the toner refilling portion 10, and the toner cartridge 9 is located at the installation position. The discharge shutter 95 is located at the closed position, and the first toner discharge portion 941 is in a state of not being aligned with the second toner discharge portion 951. The external force receiver 965 of the locking member 96 is located in the second accommodating portion 133, and thus the locking member 96 is maintained at the locked position at which the discharge shutter 95 is locked at the closed position. The second toner discharge portion 951 passes through the second slot 911 (second rotation restricting portion) and protrudes from the body 91, and as illustrated in FIG. 15, the second toner discharge portion 951 passes through the first slot 134 (first rotation restricting portion) and is inserted into the second toner inlet portion 141. The second toner discharge portion 951 is placed at a first end portion 911-1 of the second slot 911. The inlet shutter 14 is located at the blocked position, and the first toner inlet portion 121 is in a state of not being aligned with the second toner inlet portion 141. The second toner inlet portion 141 is placed at the first end portion 134-1 of the first slot 134. As such, in a state in which the inlet shutter 14 is located at the blocked position, the discharge shutter 95 is also maintained at the closed position, and thus toner leakage may be prevented.

Then, the toner cartridge 9 is rotated to the first angular position from the installation position. This is referred to as a first rotation. The first angular position may be, for example, a position apart by 90° from the installation position. During the first rotation of the toner cartridge 9, the discharge shutter 95 is in a state of being locked at the closed position by the locking member 96. When the toner cartridge 9 is rotated about the first rotation axis C1, the body 91 and the discharge shutter 95 are rotated along therewith. When the toner cartridge 9 is rotated at 90°, as illustrated in FIG. 16, the second toner discharge portion 951 reaches the first angular position in a state of being located at the first end portion 911-1 of the second slot 911. Since the discharge shutter 95 is still located at the closed position, the first toner discharge portion 941 is in a state of not being aligned with the second toner discharge portion 951. At this time, the external force receiver 965 of the locking member 96 is caught by the releasing portion 131 provided in the toner refilling portion 10. The locking member 96 escapes from the locked position and is somewhat rotated to the unlocked position. The second interference portion 963 is separated from the first interference portion 953. The intensity of the elastic force applied to the locking member 96 by the locking spring 97 is merely a degree to which the locking member 96 returns to the locked position from the unlocked position, and thus even while the external force receiver 965 is interfered with the releasing portion 131, a force needed to rotate the toner cartridge 9 is not increased much, and the toner cartridge 9 may be easily rotated.

The second toner discharge portion 951 is inserted into the second toner inlet portion 141, and thus, when the toner cartridge 9 is rotated, the inlet shutter 14 is rotated along therewith. When the toner cartridge 9 is rotated at 90°, as illustrated in FIG. 17, the inlet shutter 14 is located at the inflow position, and the second toner inlet portion 141 is aligned with the first toner inlet portion 121. The second toner inlet portion 141 is caught by the second end portion 134-2 of the first slot 134, and thus the inlet shutter 14 is unable to be rotated beyond the inflow position, and stopped at the inflow position, i.e., the first angular position. Since the second toner discharge portion 951 is inserted into the second toner inlet portion 141, the discharge shutter 95 is also unable to be rotated beyond the first angular position. Accordingly, the discharge shutter 95 may be locked at the first angular position by the first slot 134. By using the first slot 134, a state in which the second toner discharge portion 951, the second toner inlet portion 141, and the first toner inlet portion 121 are aligned with respect to one another is maintained at the first angular position. As such, the discharge shutter 95 is also maintained at the closed position by the locking member 96 until the inlet shutter 14 reaches the inflow position, and thus toner leakage may be prevented.

Next, the toner cartridge 9 is rotated from the first angular position to the second angular position. This is referred to as a second rotation. The second angular position may be, for example, a position apart by 90° from the first angular position. Since the locking member 96 is located at the unlocked position, the body 91 and the discharge shutter 95 are in a state of being rotatable relative to each other. When the toner cartridge 9 is continually rotated, the discharge shutter 95 is maintained in a state of being stopped at the first angular position, and the body 91 and the locking member 96 are rotated relative to the discharge shutter 95. In a state in which the discharge shutter 95 is stopped, when the body 91 is rotated at 90°, as illustrated in FIG. 18, the discharge shutter 95 switches to the discharge position so that the first toner discharge portion 941 is aligned with the second toner discharge portion 951. The rotation of the body 91 relative to the discharge shutter 95 is restricted by the second slot 911. When the toner cartridge 9 reaches the second angular position, the discharge shutter 95 switches to the discharge position and the second toner discharge portion 951 is caught by the second end portion 911-2 of the second slot 911. Thus, the rotation of the body 91 relative to the discharge shutter 95 is restricted by the second slot 911 so that the body 91 is not rotated beyond the second angular position. When the toner cartridge 9 reaches the second angular position, as illustrated in FIGS. 18 and 19, the first toner discharge portion 941 the second toner discharge portion 951 the second toner inlet portion 141, and the first toner inlet portion 121 are in a fluid communication with one another. As such, after the inlet shutter 14 reaches the inflow position, the discharge shutter 95 switches to the discharge position. When the plunger 93 is pressed, toner may flow from the body 91 to the toner container 230 via the first toner discharge portion 941, the second toner discharge portion 951, the second toner inlet portion 141, and the first toner inlet portion 121, thereby refilling the toner container 230.

When toner refilling is completed, the toner cartridge 9 is inversely rotated to be separated from the toner refilling portion 10. A process of the toner cartridge 9 returning to the installation position from the second angular position via the first angular position may be in an order opposite to that of the above-described installation process.

In a case in which resistance against rotation of the discharge shutter 95 relative to the body 91 is lower than resistance against rotation of the inlet shutter 14 relative to the installation portion 11 when the toner cartridge 9 is rotated to the first angular position from the second angular position, the discharge shutter 95 may be maintained at the first angular position and the body 91 and the locking member 96 may be rotated. When the body 91 reaches the first angular position, the discharge shutter 95 switches to the closed position. When the body 91 is beyond the first angular position, interference of the external force receiver 965 with the releasing portion 131 is completed, and thus the locking member 96 returns to the locked position by the elastic force of the locking spring 97. The first end portion 911-1 of the second slot 911 comes into contact with the second toner discharge portion 951. Thus, when the toner cartridge 9 is continually rotated beyond the first angular position towards the installation position, the body 91 and the discharge shutter 95 are rotated along therewith. Since the second toner discharge portion 951 is inserted into the second toner inlet portion 141, the inlet shutter 14 is rotated along with the toner cartridge 9. When the toner cartridge 9 reaches the installation position, the inlet shutter 14 reaches the blocked position. Since the second toner inlet portion 141 is caught by the first end portion 134-1 of the first slot 134, the inlet shutter 14 is stopped at the blocked position. In this state, the toner cartridge 9 may be separated from the installation portion 11 by pulling the toner cartridge 9 upward.

In a case in which resistance against rotation of the discharge shutter 95 relative to the body 91 is higher than resistance against rotation of the inlet shutter 14 relative to the installation portion 11, when the toner cartridge 9 is rotated to the first angular position from the second angular position, the discharge shutter 95, the body 91, and the locking member 96 may be rotated together. At this time, since the second toner discharge portion 951 is inserted into the second toner inlet portion 141, the inlet shutter 14 is also rotated along with the toner cartridge 9. When the toner cartridge 9 reaches the first angular position, the inlet shutter 14 reaches the blocked position. Since the second toner inlet portion 141 is caught by the first end portion 134-1 of the first slot 134, the inlet shutter 14 is stopped at the blocked position. The discharge shutter 95 is located at the discharge position. Although the first toner discharge portion 941, the second toner discharge portion 951, and the second toner inlet portion 141 are aligned with respect to one another, the second toner inlet portion 141 is blocked by the second sealing member 15, and thus toner is not leaked to the outside. When the toner cartridge 9 is continually rotated and thus is beyond the first angular position, interference of the external force receiver 965 with the releasing portion 131 is completed, and thus the locking member 96 receives the elastic force of the locking spring 97 in a direction returning to the locked position. Since the inlet shutter 14 is stopped at the blocked position and the second toner discharge portion 951 is inserted into the second toner inlet portion 141, the discharge shutter 95 is unable to be rotated. Accordingly, the body 91 is rotated relative to the discharge shutter 95, and when the toner cartridge 9 reaches the installation position, the discharge shutter 95 switches to the closed position and is locked by the locking member 96. The first end portion 911-1 of the second slot 911 comes into contact with the second toner discharge portion 951, and the rotation of the toner cartridge 9 is stopped at the installation position. In this state, the toner cartridge 9 may be separated from the installation portion by pulling the toner cartridge upward.

The toner cartridge 9 is installed/detached at/from the toner refilling portion 10 in a state in which the discharge shutter 95 is located at the closed position, and thus the leakage of toner in installation/detachment of the toner cartridge 9 and contamination of the main body 1 of the printer due to this may be prevented, and user convenience may be enhanced. In addition, after the inlet shutter 14 reaches the inflow position, the discharge shutter 95 switches to the discharge position. Accordingly, contamination of the toner refilling portion 10 due to toner may be prevented.

When the toner cartridge 9 escapes from the installation portion 11 in a state in which the discharge shutter 95 is located at the discharge position, toner may be leaked to the outside. The toner refilling interface structure of the present example may have a structure in which the toner cartridge 9 is installable/detachable at/from the installation portion 11 at the installation position. For this, the toner refilling interface structure includes a separation preventing portion configured to prevent the toner cartridge 9 from moving along the first rotation axis C1 so that the toner cartridge 9 is not separated from the installation portion 11 at a position other than the installation position. FIG. 20 is a perspective view illustrating an example of a separation preventing portion. FIG. 21 is a plan view illustrating an example of a separation preventing portion. Referring to FIGS. 20 and 21, a first stopper 99 protruding outward is provided in the body 91 of the toner cartridge 9. A second stopper 81, by which the first stopper 99 is caught, is provided in the communicating portion 8 of the main body 1. The second stopper 81 includes a groove 82 through which the first stopper 99 passes when the toner cartridge 9 is located at the installation position. The toner cartridge 9 is inserted into the communicating portion 8 in a state in which the first stopper 99 and the groove 82 are aligned with respect to each other and installed at the toner refilling portion 10. Then, the toner cartridge 9 is rotated to the second angular position. When the toner cartridge 9 is at a position other than the installation position, the first stopper 99 escapes from the groove 82 and thus is located on a lower side of the second stopper 81. Thus, even when the toner cartridge 9 is pulled towards the first rotation axis C1, the first stopper 99 is caught by the second stopper 81 so that the toner cartridge 9 is not detached from the toner refilling portion 10. To detach the toner cartridge 9 from the toner refilling portion 10, the toner cartridge 9 returns to the installation position. Then, the first stopper 99 and the groove 82 are aligned vertically, and the toner cartridge 9 may be detached from the toner refilling portion 10.

Although the example of the electrophotographic printer to which the toner cartridge 9 is applied has been described with reference to FIGS. 1 to 3, the structure of the printer is not limited to the examples illustrated in FIGS. 1 to 3. Although not shown in the drawings, a toner container (not shown) including the toner refilling portion 10 and connected to the development cartridge 2 may be provided in the main body 1 of the electrophotographic printer, and the toner cartridge 9 may be used to refill the toner container with toner. In addition, the toner cartridge 9 may be coupled to the toner refilling portion 10 even in a state in which the development cartridge 2 is detached from the main body 1, thus refilling the development cartridge 2 with toner. Also, the toner cartridge 9 may be connected to the toner refilling portion 10 in a state in which the toner container is detached from the main body 1, thus refilling the toner container with toner.

While the present disclosure has been described with reference to the examples illustrated in the drawings, these examples are provided for illustrative purposes, and it will be understood by those of ordinary skill in the art to which the disclosure pertains that various modifications and other examples equivalent thereto can be made. Therefore, the true scope of the present disclosure should be defined by the following claims.

The invention claimed is:

1. A toner refilling interface structure including:

a toner cartridge including:

a body, the body is to accommodate toner and includes a first toner discharge portion to discharge toner; and a discharge shutter, the discharge shutter is located in or coupled to the body and is to switch to a closed position at which the first toner discharge portion is closed and is to switch to a discharge position at which the first toner discharge portion is open;

an installation portion at which the toner cartridge is rotatable about a first rotation axis;

a first toner inlet portion provided in the installation portion and to receive toner from the toner cartridge;

an inlet shutter provided in the installation portion and to switch to an inflow position at which the first toner inlet portion is open, from a blocked position at which the first toner inlet portion is blocked, by a first rotation of the toner cartridge from an installation position to a first angular position; and a locking member provided in the toner cartridge and to lock the discharge shutter at the closed position during the first rotation of the toner cartridge.

2. The toner refilling interface structure of claim 1, wherein the discharge shutter is rotated about the first rotation axis to the closed position and the discharge position, and the inlet shutter is rotated about the first rotation axis to the blocked position and the inflow position.

3. The toner refilling interface structure of claim 2, further including:

a first rotation restricting portion provided in the installation portion and to lock the discharge shutter at the first angular position; and a releasing portion provided in the installation portion and to unlock the discharge shutter such that, when the toner cartridge is located at the first angular position, the releasing portion contacts the locking member, and thus the body is rotatable relative to the discharge shutter from the first angular position to a second angular position at which the first and second toner discharge portions are aligned with respect to each other.

4. The toner refilling interface structure of claim 3, further including a locking spring to apply to the locking member an elastic force in a direction in which the discharge shutter is locked at the closed position.

5. The toner refilling interface structure of claim 3, further including a second rotation restricting portion to restrict rotation of the body relative to the discharge shutter so the body is not rotated beyond the second angular position.

6. The toner refilling interface structure of claim 1, further including a separation preventing portion to prevent the toner cartridge from moving along the first rotation axis so the toner cartridge is not separated from the toner refilling portion at a position other than the installation position.

7. A toner refilling interface structure including:

a toner cartridge including:

a body including a first toner discharge portion eccentrically located with respect to a first rotation axis and to discharge toner, and to accommodate toner; and a discharge shutter including a second toner discharge portion and to rotate relative to the body about the first rotation axis to a discharge position at which the first and second toner discharge portions are aligned with respect to each other and a closed position at which the first and second discharge portions are not aligned with respect to each other;

an installation portion at which the toner cartridge is rotatable about a first rotation axis;

a locking member provided in the toner cartridge and to lock the discharge shutter at the closed position so the body and the discharge shutter are rotated together during first rotation of the toner cartridge from an installation position to a first angular position;

a first toner inlet portion provided in the installation portion and to receive toner from the toner cartridge; and an inlet shutter including a second toner inlet portion aligned with the second toner discharge portion and provided in the installation portion so the inlet shutter is rotated about the first rotation axis to an inflow position from a blocked position by the first rotation, the blocked position being a position at which the first and second toner inlet portions are not aligned with respect to each other and the first toner inlet portion is blocked, and the inflow position being a position at which the first and second toner inlet portions are aligned with respect to each other and the first toner inlet portion is open.

8. The toner refilling interface structure of claim 7, wherein the second toner discharge portion is inserted into the second toner inlet portion such that the inlet shutter is rotated to the inflow position from the blocked position during the first rotation of the toner cartridge.

9. The toner refilling interface structure of claim 8, further including a first rotation restricting portion provided in the installation portion and to contact the second toner inlet portion when the toner cartridge is located at the first angular position to not allow the discharge shutter to be rotated beyond the first angular position.

10. The toner refilling interface structure of claim 9, wherein the installation portion includes a lower body to rotatably support the inlet shutter and an upper body to cover the inlet shutter and coupled to the lower body; and the first rotation restricting portion includes a first slot passing through the upper body so the second toner discharge portion is inserted into the second toner inlet portion through the first slot, the first slot including first and second end portions at which the second toner inlet portion is located at the installation position and the first angular position, respectively, and having a circular arc shape.

11. The toner refilling interface structure of claim 9, further including a releasing portion provided in the installation portion and to unlock the discharge shutter so, when the toner cartridge is located at the first angular position, the releasing portion contacts the locking member, and the body is rotatable relative to the discharge shutter from the first angular position to a second angular position at which the first and second toner discharge portions are aligned with respect to each other.

12. The toner refilling interface structure of claim 11, further including a locking spring to apply to the locking member an elastic force in a direction in which the discharge shutter is locked at the closed position.

13. The toner refilling interface structure of claim 11, further including a second rotation restricting portion to contact the second toner discharge portion when the body is located at the second angular position so the body is not rotated beyond the second angular position.

14. The toner refilling interface structure of claim 13, wherein the body includes a first body to accommodate toner and including the first toner discharge portion, and a second body coupled to the first body and so the discharge shutter is located between the second body and the first body, and the second rotation restricting portion includes a second slot passing through the second body so the second toner discharge portion protrudes outside of the second body through the second slot, the second slot including first and second end portions at which the second toner discharge portion is located at the closed position and the discharge position, respectively.

15. The toner refilling interface structure of claim 7, further including a separation preventing portion to prevent the toner cartridge from moving along the first rotation axis so the toner cartridge is not separated from the installation portion at a position other than the installation position.

* * * * *